US007059826B2

(12) United States Patent
Lasko

(10) Patent No.: US 7,059,826 B2
(45) Date of Patent: Jun. 13, 2006

(54) MULTI-DIRECTIONAL AIR CIRCULATING FAN

(75) Inventor: William E. Lasko, Chester Springs, PA (US)

(73) Assignee: Lasko Holdings, Inc., Wilmington, DE (US)

( * ) Notice: Subject to any disclaimer, the term of this patent is extended or adjusted under 35 U.S.C. 154(b) by 92 days.

(21) Appl. No.: 10/750,132

(22) Filed: Dec. 31, 2003

(65) Prior Publication Data

US 2005/0019155 A1 Jan. 27, 2005

Related U.S. Application Data

(60) Provisional application No. 60/490,375, filed on Jul. 25, 2003.

(51) Int. Cl.
*F03B 11/02* (2006.01)

(52) U.S. Cl. ..... 415/127; 416/121; 416/126; 416/247 R

(58) Field of Classification Search ..... 416/120, 416/121, 123, 124, 127, 128, 130, 175, 101, 416/247 R, 244 R, 246; 415/126, 127, 143
See application file for complete search history.

(56) References Cited

U.S. PATENT DOCUMENTS 6,321,034 B1 11/2001 Jones-Lawlor et al.
6,830,433 B1 * 12/2004 Birdsell et al. ..... 416/110
2004/0022631 A1 2/2004 Birdsell et al.

* cited by examiner

*Primary Examiner*—Edward K. Look
*Assistant Examiner*—Dwayne J White
(74) *Attorney, Agent, or Firm*—RatnerPrestia

(57) ABSTRACT

A multi-directional air circulation device for use in a living space. The multi-directional air circulation device comprises a first housing having i) a first wall portion defining a first interior space, ii) a first air outlet, and iii) a first air directing grill adjacent to the first air outlet. At least a second housing rotatable with respect to the first housing. The second housing having i) a second a wall portion defining a second interior space, ii) a second air outlet and, and iii) a second air directing grill adjacent to the second air outlet. At least one air generator is placed in the housings and used to generate at least one air stream which is then discharged from said device as at least two independently directed air exhaust streams through the first and second air outlets into said living space.

42 Claims, 20 Drawing Sheets

| With Grill | |
|---|---|
| Angle | Air Velocity f.p.m. |
| 90° | 0 |
| 85° | 0 |
| 80° | 0 |
| 75° | 0 |
| 70° | 0 |
| 65° | 0 |
| 60° | 0 |
| 55° | 0 |
| 50° | 0 |
| 45° | 0 |
| 40° | 0 |
| 35° | 0 |
| 30° | 0 |
| 25° | 0 |
| 20° | 0 |
| 15° | 160 |
| 10° | 350 |
| 5° | 520 |
| 0° | 610 |
| -5° | 210 |
| -10° | 0 |
| -15° | 0 |
| -20° | 0 |
| -25° | 0 |
| -30° | 0 |
| -35° | 0 |
| -40° | 0 |
| -45° | 0 |
| -50° | 0 |
| -55° | 0 |
| -60° | 0 |
| -65° | 0 |
| -70° | 0 |
| -75° | 0 |
| -80° | 0 |
| -85° | 0 |
| -90° | 0 |

| No Grill | |
|---|---|
| Angle | Air Velocity f.p.m. |
| 90° | 0 |
| 85° | 0 |
| 80° | 0 |
| 75° | 0 |
| 70° | 0 |
| 65° | 0 |
| 60° | 0 |
| 55° | 0 |
| 50° | 0 |
| 45° | 0 |
| 40° | 0 |
| 35° | 0 |
| 30° | 0 |
| 25° | 0 |
| 20° | 0 |
| 15° | 0 |
| 10° | 0 |
| 5° | 0 |
| 0° | 0 |
| -5° | 0 |
| -10° | 0 |
| -15° | 0 |
| -20° | 0 |
| -25° | 0 |
| -30° | 0 |
| -35° | 0 |
| -40° | 260 |
| -45° | 524 |
| -50° | 640 |
| -55° | 580 |
| -60° | 405 |
| -65° | 115 |
| -70° | 0 |
| -75° | 0 |
| -80° | 0 |
| -85° | 0 |
| -90° | 0 |

MULTI-DIRECTIONAL AIR CIRCULATING FAN

This application claims priority on provisional patent application Ser. No. 60/490,375 filed Jul. 25, 2003.

FIELD OF THE INVENTION

This invention relates generally to air circulating fans for use in a household, office or work area environment. More specifically, the present invention relates to an air generator and an air directing grill to direct the generated air stream to a desired location or multiple locations.

BACKGROUND OF THE INVENTION

Various air movement devices have been utilized to generate an air stream. Many of these devices have been used to specifically create an air stream for the purpose of cooling a user.

The normal use of a conventional device is to provide a cooling sensation to the user by passing a current of air generated by the air moving device over the skin of an individual. The current of air that passes over an individual serves to increase the convective heat loss of the body through the natural evaporative process of moisture (e.g. sweat) on the skin. The greater the amount of evaporation, the greater the cooling sensation.

Many conventional devices are positioned either on the floor, a tabletop, or desktop. The area that the air stream effects is fixed based on the single air stream being exhausted over a fixed area by the device. FIG. 1 shows a conventional fixed air movement device 100 and the effect on user 102 regarding the stationary characteristic of the generated air stream 104. As shown, fixed air moving device 100 generates a stationary air stream 104. Air stream 104 will have its desired effect on user 102 provided that user 102 is within the effected coverage area 106 of air stream 104. If user 102 should move to an area 108 outside of coverage area 106 of air stream 104, the intended purpose of fixed air movement device 100 is nullified. In order to direct the air stream to a different area using a conventional device, the user typically needs to physically re-position the device. Thus these conventional devices will not allow multiple users in multiple locations to simultaneously experience the cooling sensation provided by the device.

Oscillating mechanisms have been incorporated for use with air moving devices. Oscillation allows the air stream to be constantly swept across a larger area, thus increasing the coverage area of the air stream. This allows the user to relocate within a larger air stream coverage area without the need to physically move the device.

Air moving devices that rely solely on an oscillation mechanism for an increased air stream coverage area have two distinct disadvantages. First, the effects experienced by the user are intermittent, in that the oscillation mechanism redirects the air stream in a direction away from the user for a period of time during an oscillation cycle. Second, as the air stream sweeps across an area, objects within the area are effected in an undesired manner. FIG. 2 shows a conventional oscillating air movement device 200. As shown, air movement device 200 generates air stream 204 that is moved within coverage area 206 by virtue of the oscillating motion 210 of oscillating air movement device 200. User 202 can now be located within the larger area 206 and benefit from the cooling effect of air movement device 200. It should be noted, however, that the cooling effect that user 202 will experience from air stream 204 will be intermittent, in that the user 202 will only feel the effects of air stream 204 when it is in area 206*a* and the user 202 will not feel the desired cooling effects when air stream 204 moves to an area 206*b*, 206*c* where user 202 is not positioned. The intermittent characteristic of the effect that air stream 204 has on user 202 decreases the efficiency of the cooling sensation on user 202.

As shown in FIG. 2, any object that is within coverage area 206 will be affected by air stream 204. As a result, loose objects, such as paper that are within area 206, may be moved as air stream 204 passes. This may not be desirable as these objects can be dislodged from their intended place. Further, this means that any dust, pollen or dander within coverage area 206 will be disturbed and airborne as air stream 204 passes. This dust and debris can be detrimental to, for example, respiratory conditions.

What is needed is an air movement device that allows the air stream to be divided into multiple streams and directed to multiple areas simultaneously. What is also needed is an air movement device that allows the user the option of fixing these multiple air streams or the ability to oscillate these multiple air streams as desired. What is also needed is an air circulation device that further allows the oscillation feature to be adjustable to increase and/or decrease the coverage area of oscillation, and allow the generated air stream to return to the user's position more frequently during oscillation cycle. In short, what is needed is an air movement device that would allow the user the choice of fixed, enhanced oscillation and multi-directed air streams.

SUMMARY OF THE INVENTION

In view of the shortcomings of the prior art, the present invention is a multidirectional air circulating fan. The multidirectional air circulating fan comprises a first housing having i) a first wall portion defining a first interior space, ii) a first air outlet, and iii) a first air directing grill adjacent to the first air outlet; at least a second housing rotatable with respect to the first housing, the second housing having i) a second a wall portion defining a second interior space, ii) a second air outlet and, iii) a second air directing grill adjacent to the second air outlet; and at least one air generator, the at least one air generator used to generate at least one air stream, the at least one air stream being discharged from the device via the first and second outlets and the first and second air directing grills as at least two air exhaust streams through the first and second air outlets into the living space, the at least two air exhaust streams being independently directed from one another.

According to another aspect of the invention, the housings rotate about a common axis of rotation.

According to yet another aspect of the invention, the fan has a base rotatably coupled to the first housing such the housing oscillates and/or rotates with respect to the base.

According to a further aspect of the invention, the base further comprises a controller for controlling any combination of power, speed and/or oscillation of the fan.

According to still another aspect of the invention, the air generator comprises a motor at least partially disposed in at least one of the first housing and the second housing, and at least one air impeller coupled to the motor, the at least one air impeller at least partially disposed in the first housing and the second housing.

According to yet a further aspect of the present invention, the air generator is a centrifugal blower.

According to yet another aspect of the present invention, the multidirectional fan further comprises a base coupled to the first housing, and the air generator further comprises a motor at least partially disposed within the base; and at least one air impeller coupled to the motor, the at least one air impeller at least partially disposed within the first housing and the second housing.

According to a further aspect of the present invention, the housings are more than two housings, each of the housings comprising a respective first end and a respective second end. The more than two housings are aligned with one another substantially end to end such that the first end of the second housing is proximate the second end of the first housing and the respective second end of each successive housing is proximate the respective first end of each preceding housing.

According to still another aspect of the present invention, the first and second housing further comprise respective wall members to divide the first and second interior spaces into respective inlet interior spaces and outlet interior spaces to prevent the exhaust air streams from mixing with the inlet air.

According to a further aspect of the present invention, the maximum velocity vectors of the air exhaust streams are co-linear to respective centerlines of the air directing grills within an angle of +/−35 degrees relative to the centerline of the air directing grills.

According to yet a further aspect of the present invention, a reduction of the velocity of the maximum velocity vector of the air exhaust streams, when measured at 18 inches from a face of the air directing grills, is less that 80% of the maximum face velocity of the air exhaust streams when measured on the surface of an air exit side of the air directing grills.

According to yet another aspect of the present invention, an air passage is formed between the first housing and the second housing for communicating at least a portion of the at least one air stream from the first housing into the second housing.

According to still a further aspect of the present invention, a mounting base is coupled between the first housing and the second housing, with the mounting base coupled to a mounting surface such that one or both housing may be rotate and/or oscillate with respect to the mounting surface.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following Figures.

DETAILED DESCRIPTION OF THE INVENTION

The following is a description of a multi-directional air circulation fan that allows the air stream to be divided into multiple streams which can be directed to multiple areas simultaneously. The multi-direction air circulating fan described herein also allows the user the option of allowing these multiple air streams to be stationary or the ability to oscillate the multiple air streams as desired. The described device is a multi-directional air circulating fan that further allows the oscillation feature to be adjustable to increase and/or decrease the coverage area of oscillation, thus allowing the generated air stream to return to the user's position more frequently during the oscillation cycle. In brief the multi-directional air circulating device described will allow the user the choice of fixed, enhanced oscillation and multi-directed air streams. When in use as a desk or table top fan, for example, the user benefits from the multiple air streams, one at an upper level to cool his face, for example, and another air stream to provide air circulation to equipment in use, such as a computer monitor or laptop computer.

Figure 3A:
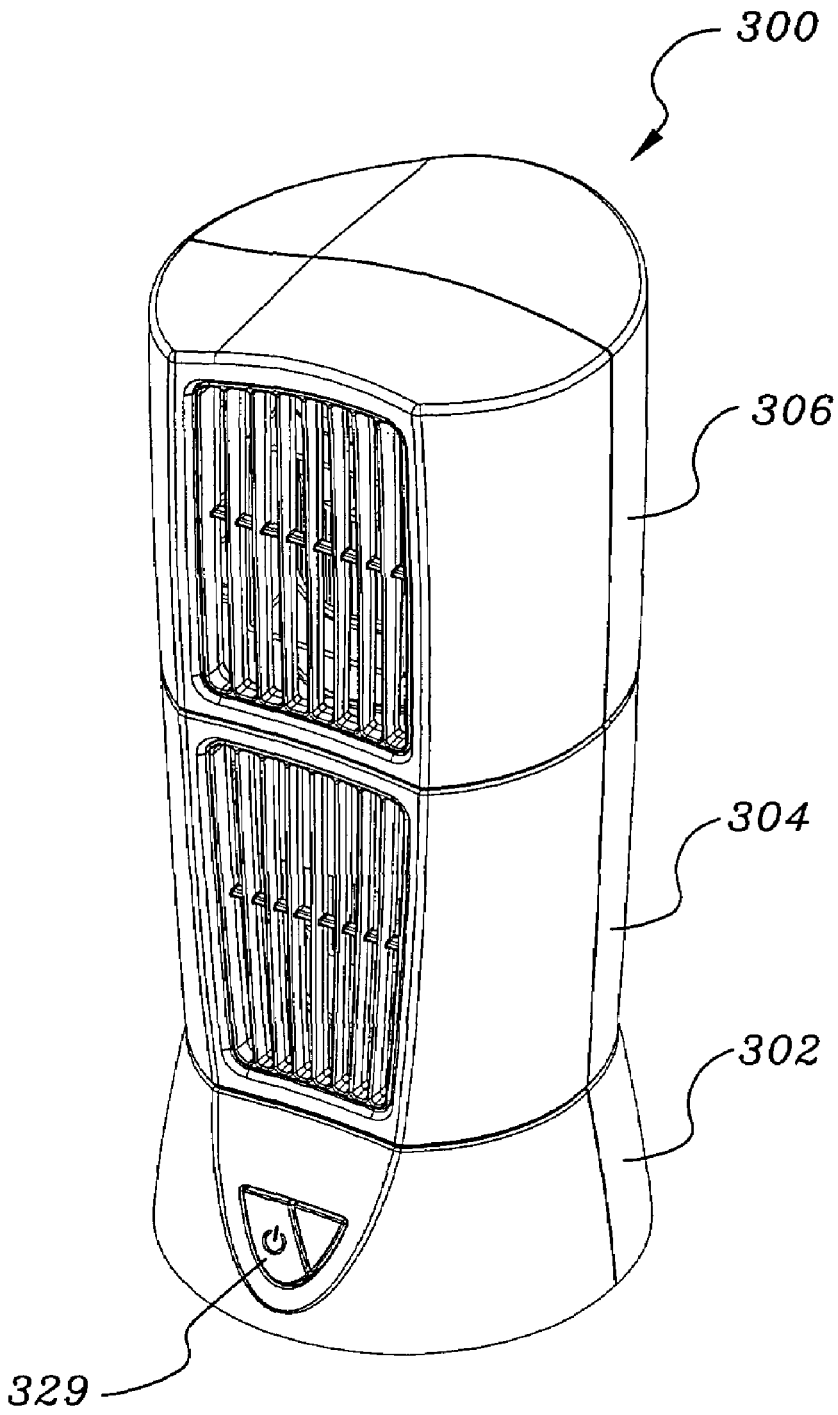
FIG. 3A is a perspective view of a first exemplary embodiment a multi-directional air circulating fan of the present invention.
Figure 3B:
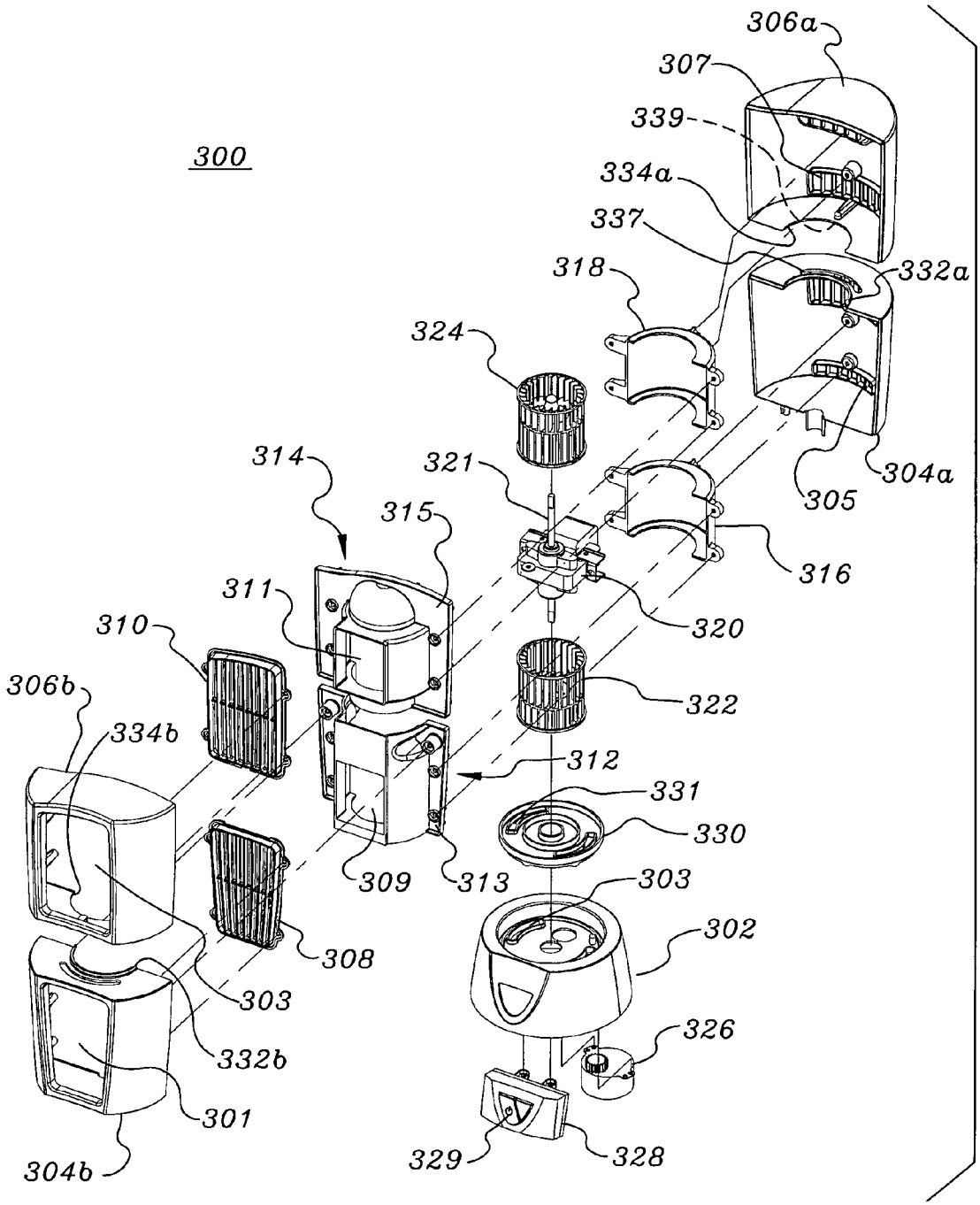
FIG. 3B illustrates an exploded view of the exemplary embodiment of FIG. 3A.

FIGS. 3A and 3B illustrate a first exemplary embodiment of a multi-directional air circulating fan of the present invention. As shown in FIG. 3A, multi-directional fan 300 includes base 302, lower housing or first housing 304 coupled to base 302, and upper housing or second housing 306 coupled to lower housing 304. Base 302 is defined by the portion of multi-directional fan 300 that remains stationary relative to the surface on which multi-directional fan 300 is placed or mounted. In one exemplary embodiment, base 302 may also includes controls 329, such as on/off control and/or oscillation control.

FIG. 3B, shows an exploded perspective view of multi-directional fan 300. As shown in FIG. 3B, multi-directional fan 300 comprises motor 320, such as a multi-speed motor for example, having one of more shafts 321 that rotate with respect to the frame member of motor 320. Shafts 321 are in turn coupled to one or more air impellers 322, 324, which in the embodiment show a substantially circular cross section.

Base 302 may include controller 328 (which includes the aforementioned controls 329) and, optionally, oscillation control mechanism 326, such as a motor of well known type. If optional oscillation motor 326 is used, it is desirably coupled to turntable 330 which is disposed in upper section of base 302. Turntable 330 is in turn coupled to lower housing 304. Thus, when oscillation motor 326 is activated, lower housing 304 will oscillate accordingly.

In one exemplary embodiment, the range of oscillation is set based on arcuate portions 303 and 331 disposed within base 302 and turntable 330, respectively. Although the exemplary embodiment shows turntable 330 as separate from lower housing 304, the invention is not so limited as it is also possible that the function of turntable 330 may be incorporated into lower housing 304.

As shown, lower housing 304 is comprised of front housing 304*b*, which includes air outlet 301, and rear housing 304*a*, which includes air inlet 305. Housing 304*b* and housing 304*a* are coupled to one another. Disposed within lower housing 304 is an air generation portion comprised of front section 312, which includes exhaust port 309 and rear section 316 coupled thereto, with air impeller 322 disposed within space 323 (best seen in FIGS. 3D and 3G) formed by front section 312 and rear section 316.

Additionally, a grill 308 may be coupled to the inside of front housing 304*b* proximate air outlet 301 although it is also possible to couple grill 308 at the outside of housing 304*b* if desired. In one exemplary embodiment, rear section 316 is coupled to rear housing 304*a*, and front section 312 is coupled to rear section 316 using well known attaching means, such as screws or adhesives for example.

Upper housing 306 is comprised of essentially the same elements described above with respect to lower housing 304, specifically, grill 310 located proximate air outlet 303, an air generation portion comprising front section 314, rear section 318, and air impeller 324. These various elements are coupled to and/or disposed within one another similar to lower housing 304.

Figure 3E:
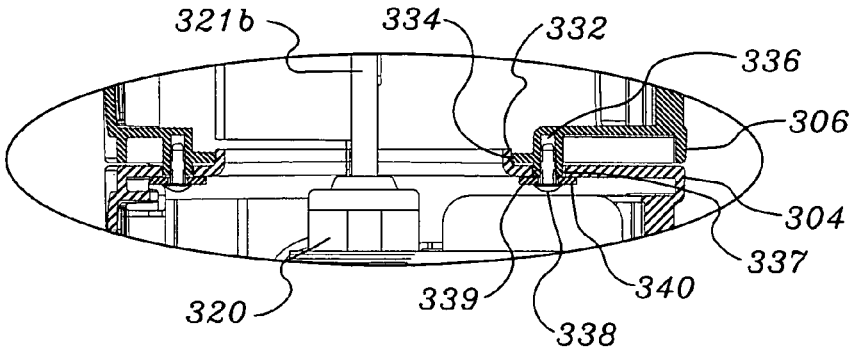
FIGS. 3C–3E illustrate a detailed view of an exemplary coupling that allows articulated movement of the housings of the exemplary embodiment of FIG. 3A.
Figure 3C:
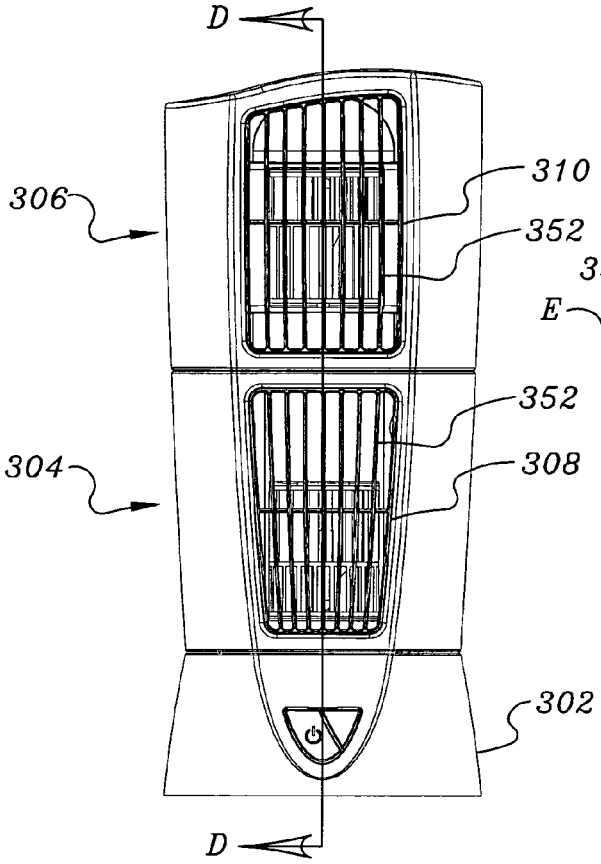
Figure 3D:
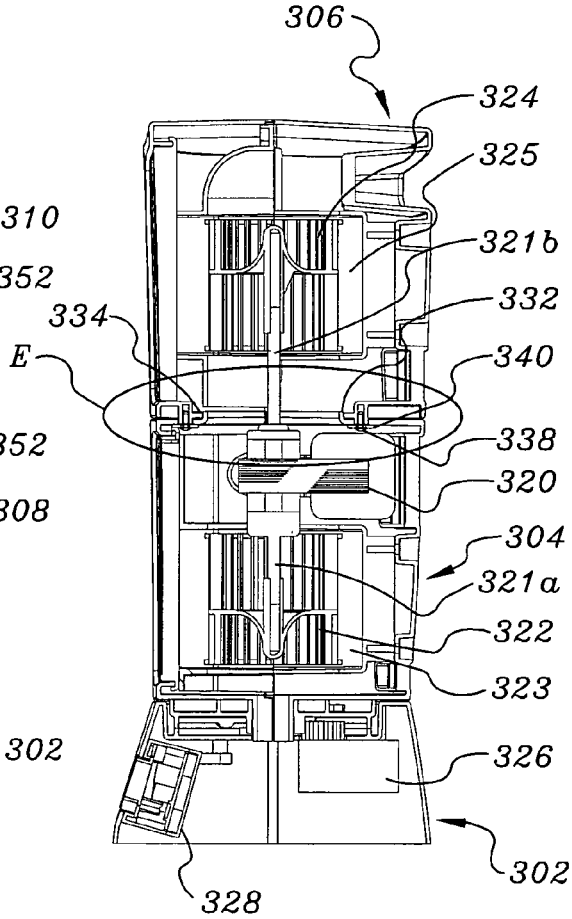

FIGS. 3C, 3D and 3E, show details of the exemplary coupling between upper housing 306 and lower housing 304. As shown in FIG. 3D, upper housing 306 is rotatably connected to lower housing 304 through the use of a coupling. In one embodiment shown, the coupling comprises, sleeve 332, collar 334, attaching means 338, such as a screw, and washer 340. This embodiment is best shown in the enlarged detail view of FIG. 3E.

As shown in FIG. 3E, sleeve 332 is formed at an upper portion of lower housing 304 and may be an integral part thereof. In addition, groove 337 is formed in the upper surface of lower housing 304 to receive shoulder 339 formed in a lower portion of upper housing 306. The interaction of shoulder 339 as it rides within groove 337 limits the rotation of upper housing 306 relative to lower housing 304. In one exemplary embodiment, the rotation range of upper housing 306 relative to lower housing 304 is about 65 degrees. In another exemplary embodiment, the rotation range is up to a full 360 degrees.

Adjacent to shoulder 339 is collar 334 which is also formed at the lower portion of upper housing 306. Collar 334 is disposed adjacent to and guided by sleeve 332. In assembly, shoulder 339 is placed within groove 337 and collar 334 is placed against sleeve 332. Attaching means 338, such as a screw or rivet for example, coupled into mounting hole 336 formed in upper housing 306, is used to maintain structural integrity between the upper an lower housings. In addition, to provide a smooth low friction surface for rotation of upper housing 306 relative to lower housing 304, a bearing surface 340, such as a nylon washer for example, may be placed between the head of attaching means 338 and inner surface of lower housing 304.

Alternatively and/or additionally, it is also possible to add a lower friction surface between upper and lower housings 304, 306 if desired. Furthermore, in order to provide the user with positive feedback and/or stops during rotation of the upper housing, detents may be provided in one or both of upper and lower housings (not shown). Although the above description places certain elements within the upper housing and certain elements within the lower housing, the invention is not so limited as it is also possible to change the location of these various elements and still achieve rotation of the upper housing 306 relative to the lower housing 304.

Referring again to FIG. 3D, upper housing 306 may include an air impeller 324, air generator motor 320, a control section 328, or any combination thereof. Lower section 304 may include an air impeller 322, air generator motor 320, a control section 328, or any combination thereof. Motor shaft 321*a* or 321*b* extends from the housing (upper or lower) in which motor 320 is mounted into the adjacent housing to drive a respective air impeller. As described above, air generator motor 320 may be disposed within either lower housing 304 or upper housing 306 or base 302. It is also possible to dispose a portion of air generator motor 320 within each of lower housing 304 and upper housing 306, as desired.

Figure 3F:
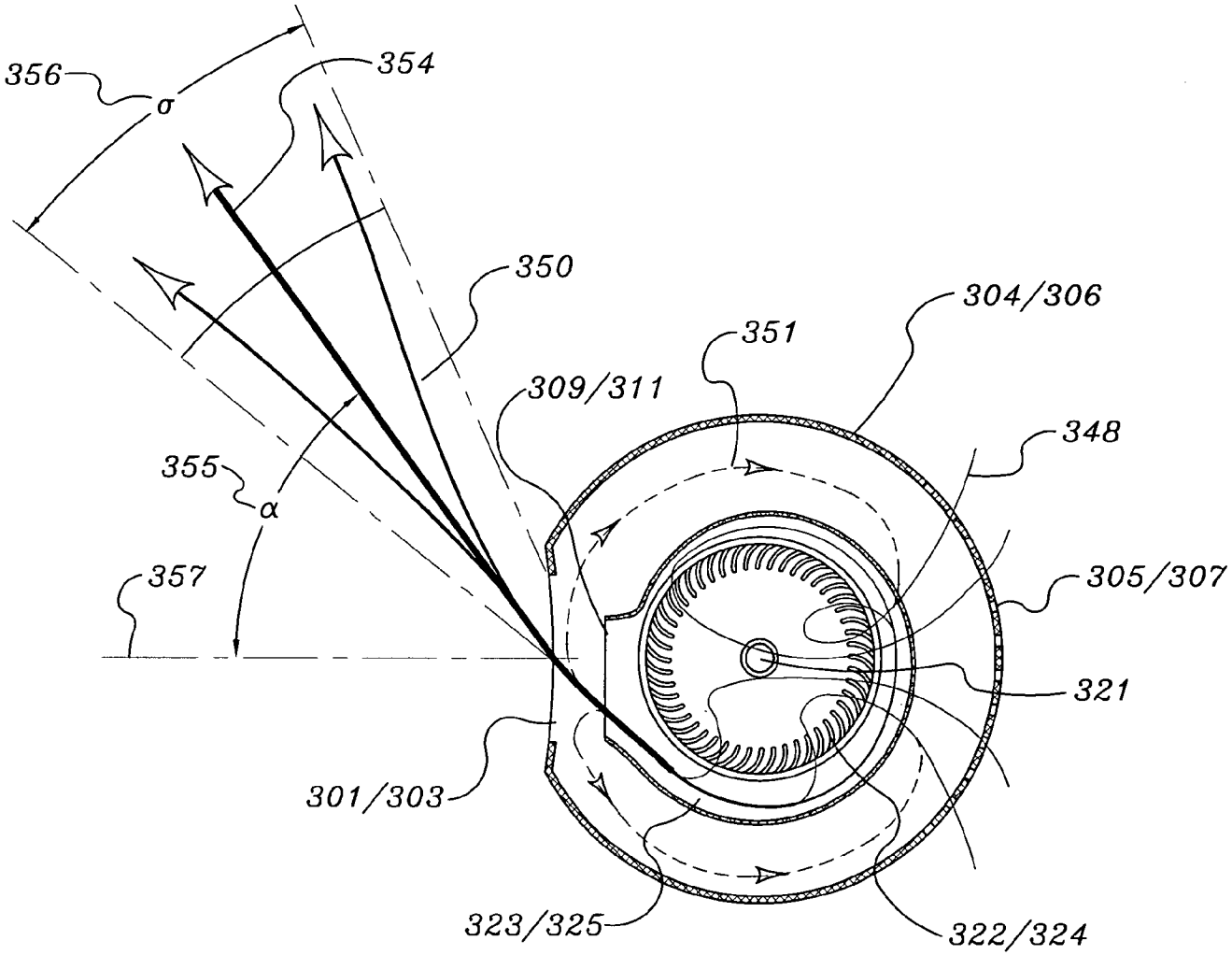
FIGS. 3F–3H illustrate the effects of an interior dividing wall on the dynamics of the generated air stream according to an exemplary embodiment of the present invention.
Figure 3G:
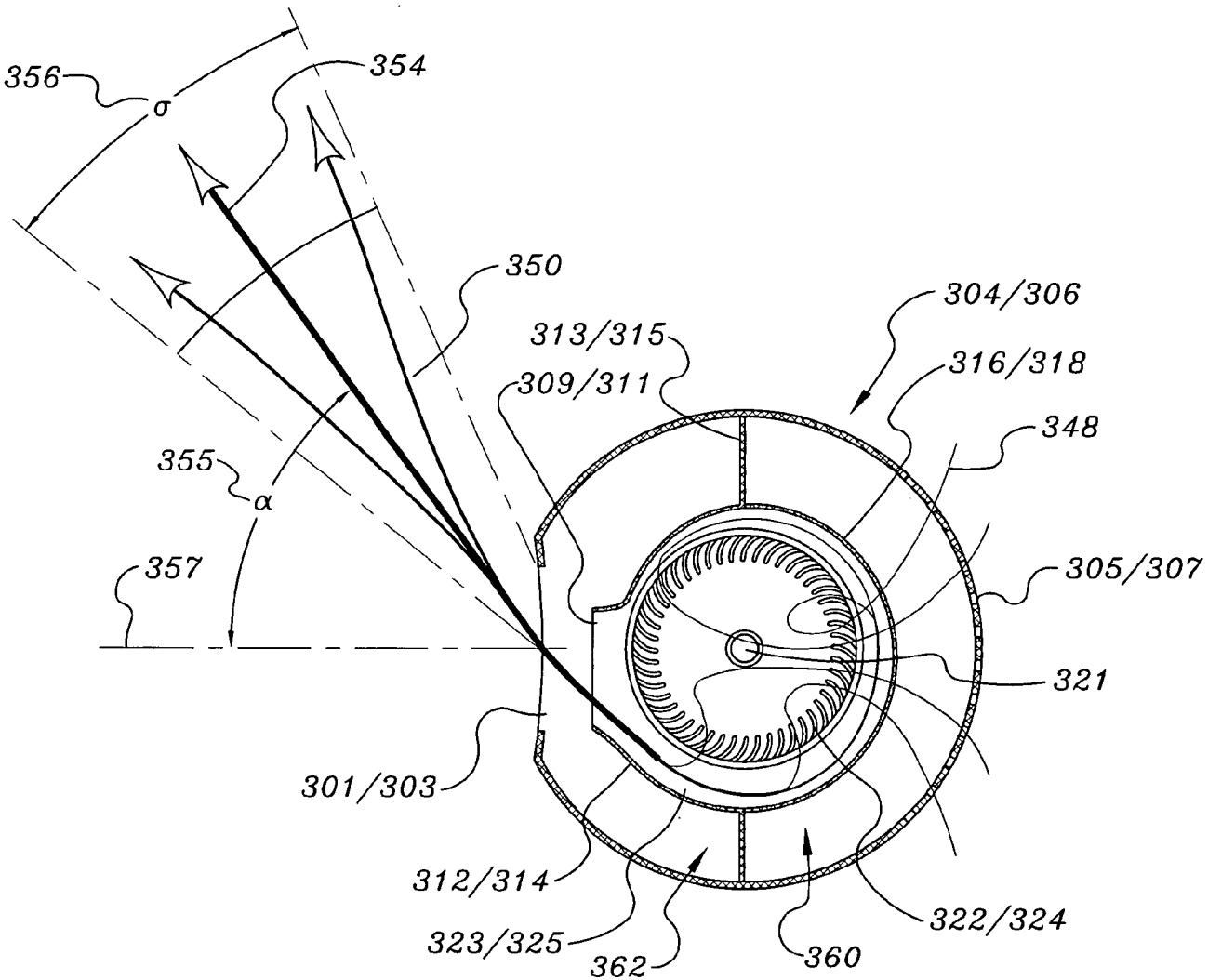
Figure 3H:
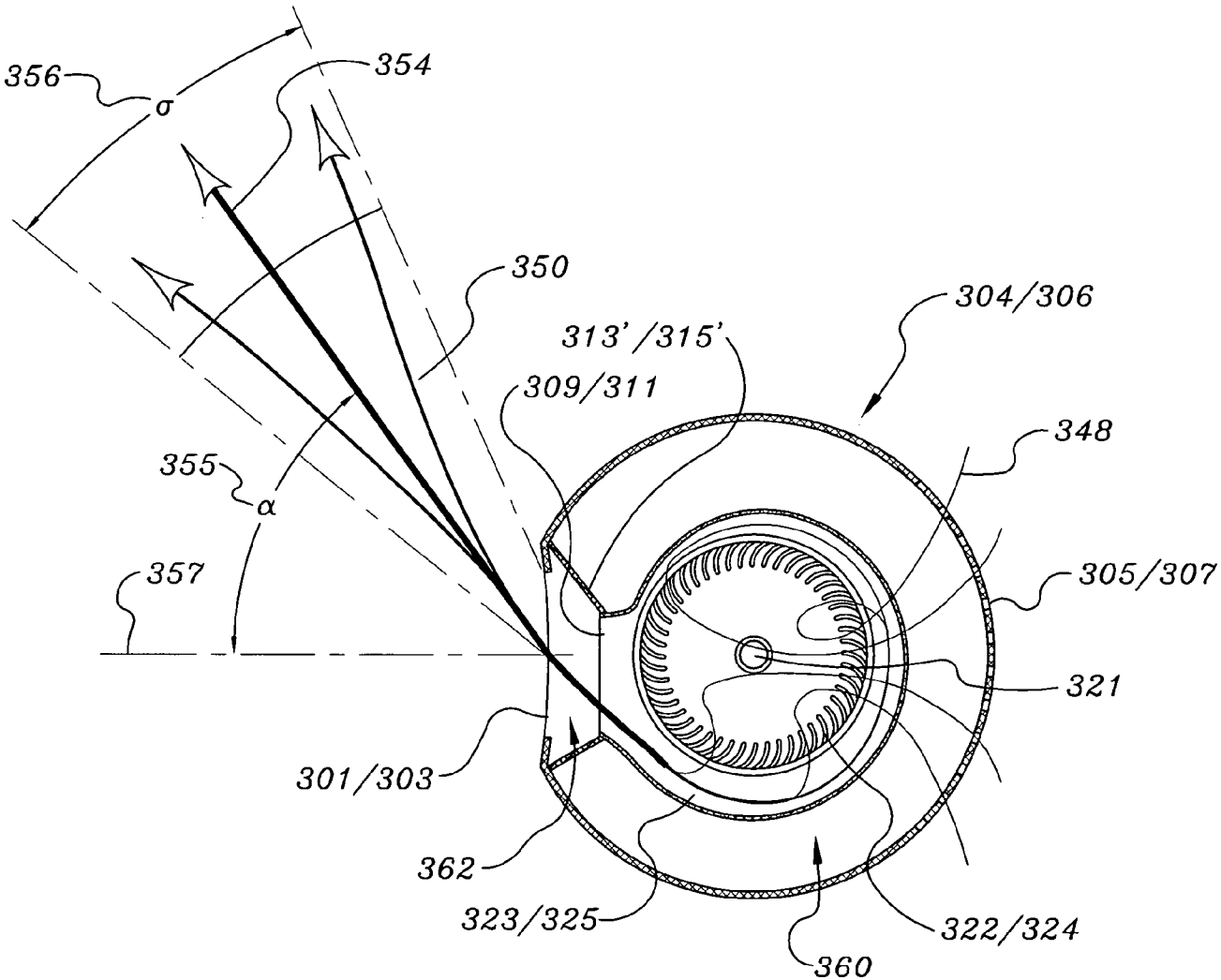

FIGS. 3F, 3G and 3H, illustrate airflow through an exemplary multi-directional air circulating fan 300. As shown in FIG. 3F, intake air 348 enters housings 304, 306 thru air inlets 305, 307 and flows toward rotating air impellers 322, 324. The rotation of air impellers 322, 324 converts intake air 348 into exhaust air 350 which ultimately exits housing 304, 306 through air outlet 301, 303. As shown in FIG. 3F, a portion 351 of exhaust air 350 flows back into housing 304, 306 and mixes with intake air 348. As a result, efficiency is of the air generator is reduced.

To overcome this deficiency, and as shown in FIG. 3G, a preferred embodiment of the present invention utilizes walls 313, 315 As shown in FIG. 3G, each of front section 312, 314, include walls 313, 315, respectively, which extend between the inner walls of lower housing 304 and upper housing 306, respectively, dividing the upper and lower housings into two distinct sections, an inlet section 360 and an outlet section 362. Walls 313, 315 prevent the recirculation of exhaust air 350, thereby increasing the efficiency of multi-directional air circulating fan 300.

The benefit of walls 313, 315 is illustrated in FIG. 3G when compared to FIG. 3F.

Although walls 313, 315 are illustrated as being oriented at about 180 degrees relative to one another, the invention is not so limited. For example, and as illustrated in FIG. 3H walls 313', 315' may be disposed at any desired angle so as to cut off recirculation of exhaust air 350 back into the intake air 348. In the embodiment shown in FIG. 3H, walls 313', 315' are placed adjacent exhaust port 309, 311, respectively.

FIGS. 3F, 3G and 3H also illustrate the exit angle $\alpha$ 355 at which the maximum velocity vector 354 of air stream 350 exits the multi-directional air circulating fan 300 thru exhaust ports 309, 311 and air outlets 301, 303. Angle $\alpha$ 355 is measured relative to centerline 357 of air outlets 301, 303. Also illustrated is the angular area of dissipation $\sigma$ 356 of air stream 350. The exit angle α 355 and the angular area of dissipation σ 356 reduces the ability of the user to direct air stream 350 as desired.

Figure 3I:
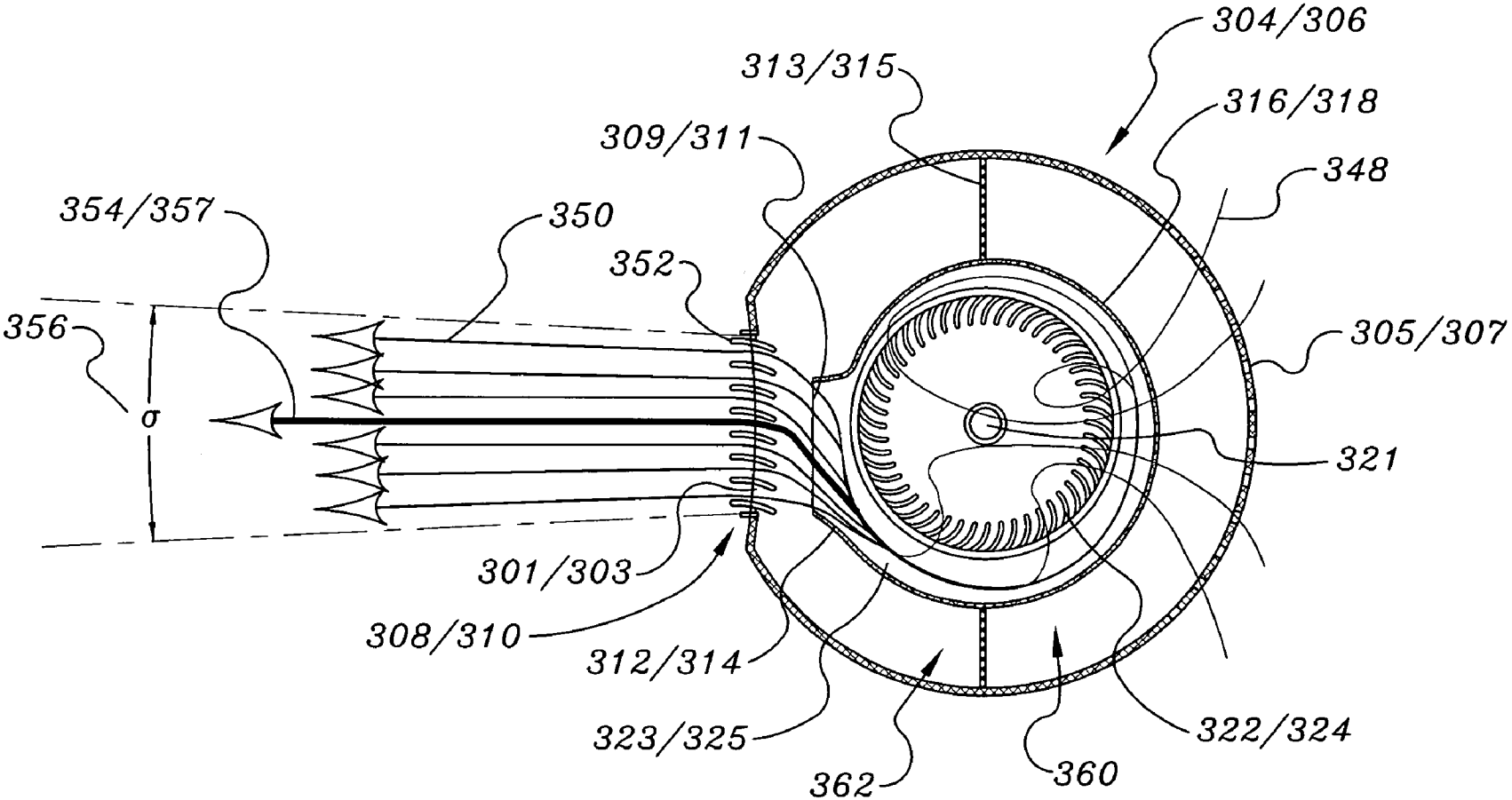
FIGS. 3I–3L illustrate the effects of the air directing grill on the dynamics of the generated air stream according to an exemplary embodiment of the present invention.

FIG. 3I is an illustration of an exemplary embodiment of air directing grills 308, 310 which are located proximate air outlets 301, 303 and exhaust ports 309, 311. Air directing grills 308, 310 are comprised of grill elements 352 which serve several purposes, including:

The spacing of grill elements 352 impede the penetration of objects (not shown) into the interior space of housings 304, 306. This protects the air impeller 322, 324 from damage; and The use of air directing grills 308 and 310 redirects maximum velocity vector 354 of air stream 350 to exit the multi-directional air circulating fan 300 substantially co-linear with centerline 357 of air directing grills 308, 310. The use of air directing grills 308 and 310 also reduce the angular area of dissipation σ 356 by approximately 20% as compared to not using grills. These features allow the user to more easily direct air stream 350 as desired.

Referring again to FIGS. 3F, 3G, 3H and 3I, when air directing grills 308, 310 are located proximate air outlet 301, 303 and blower outlet 309, 311, respectively, air directing grill 308, 310 will reduce the maximum velocity of air stream 350 when measured on outlet face of air directing grills 308, 310 by less than about 35% as compared to un-obstructed air outlets 301, 303 illustrated in FIG. 3G. This will insure minimal impedance to the flow and velocity of air stream 350.

Figure 3L:
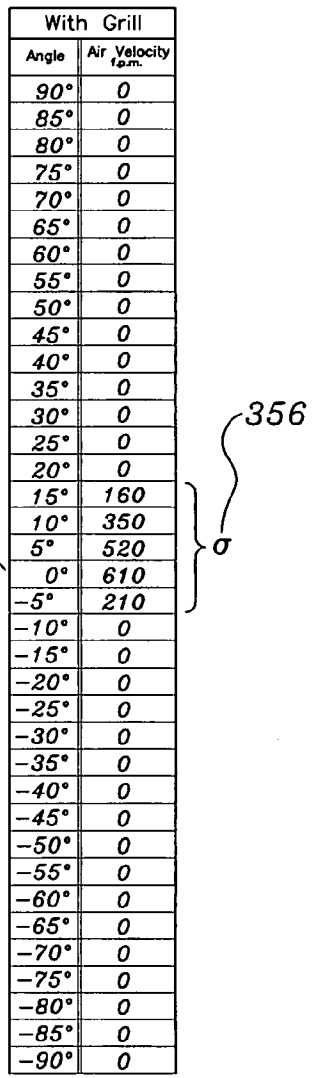
Figure 3K:
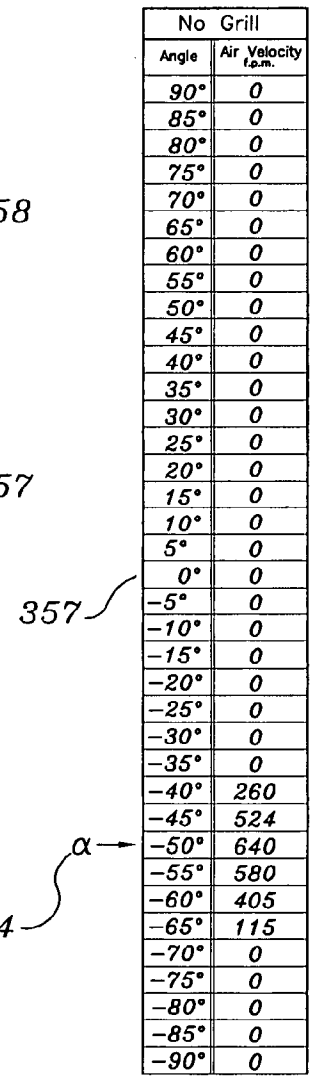
Figure 3J:
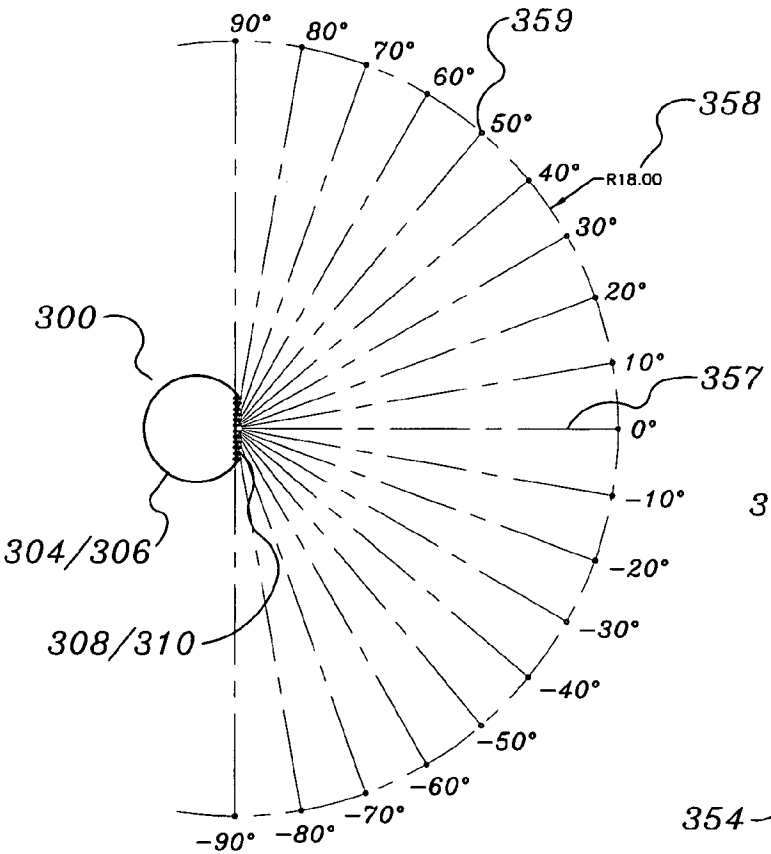

FIGS. 3J, 3K and 3L, illustrate experimental data showing the effects of air directing grills 308, 310. FIG. 3J illustrates a multi-directional fan 300 with air directing grills 308, 310 located at center of 18 inch radius 358. Data collection points 359 are equally spaced along radius 358 relative to centerline 357 of air directing grills 308, 310.

FIG. 3K illustrates an air stream velocity data table for a multi-directional air circulating fan 300 with no air directing grills 308, 310. The maximum velocity vector 354 is measured at angle α 355 at about −50 degrees relative to centerline 357 of air outlet 301, 303. The angular area of dissipation σ 356 is also measured between about −40 degrees and about −65 degrees.

FIG. 3L illustrates an air stream velocity data table for a multi-directional air circulating fan 300 utilizing air directing grills 308, 310. The maximum velocity vector 354 is measured at angle α 355 substantially co-linear to centerline 357 of air directing grills 308, 310. The angular area of dissipation σ 356 is also measured between about +20 degrees and about −5 degrees. The angular area of dissipation σ 356 has been reduced by about 20% when compared to data from FIG. 3K.

In one exemplary embodiment, grill elements 352 have a leading edge curved toward exhaust ports 309, 311 so as to minimize resistant and/or interference with exhaust air 350, thus providing a substantially free flow path. In one exemplary embodiment the air flow velocity of air stream 350 has a maximum face velocity, when measured on the surface of the air exit side of air directing grills 308, 310 of greater than about 475 fpm when the air directing grills 308, 310 are located proximate air outlets 301, 303 and blower outlets 309, 311.

In another exemplary embodiment the reduction of the maximum velocity measured at about 18 inches from the face of grills 308, 310 when compared to the maximum face velocity measured on the surface of the air exit side of air directing grills 308, 310 will be less than about 80%.

In another exemplary embodiment an airflow velocity of exhaust air stream 350 is about 350 fpm measured at about 40 inches from air directing grill 308, 310.

Figure 3M:
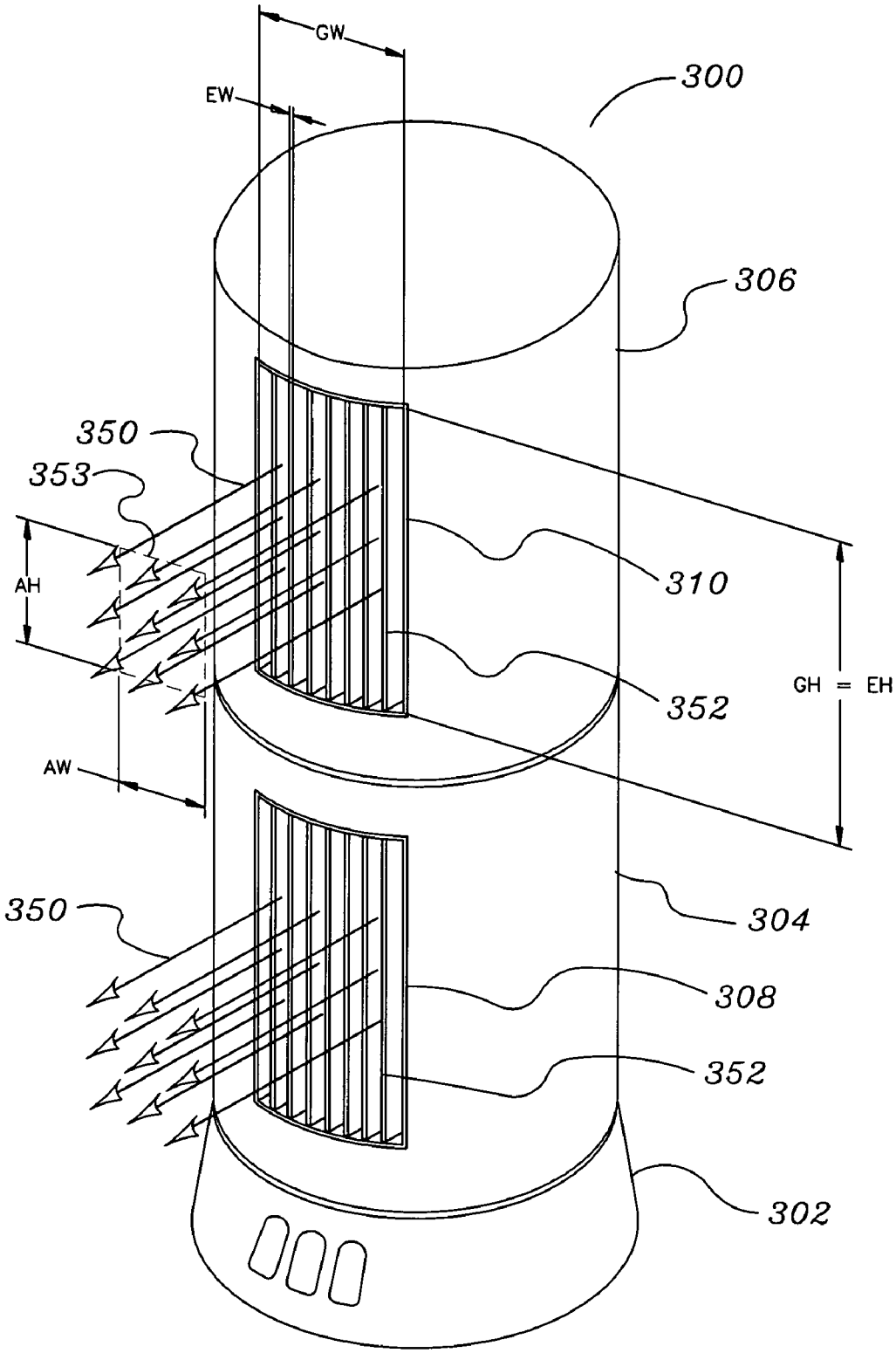
FIG. 3M illustrates exemplary proportions and areas of an air directing grill according to an exemplary embodiment of the present invention.

FIG. 3M illustrates exemplary proportions of air directing grills 308, 310. Grill elements 352 are also dimensioned/configured so as to minimize their impedance to the flow of air stream 350 as it exits multi-directional air circulating fan 300. As shown, in an exemplary embodiment of the present invention, the overall dimensions of the air directing grills 308, 310 are comprised of height "GH" and width "GW." Grill elements 352 also have a height "EH" and a width "EW." Although the air directing grills 308,310 may have dimensions as described it is possible that the exhaust area 353 of air stream 350 will be much smaller. The exhaust area 353 of air stream 350 has a height "AH" and a width "AW". Height "AH" and width "AW" are determined by air exiting from air directing grills 308, 309. The exhaust area 353 may correlate substantially to the area of blower outlets 309, 311, as best shown in FIG. 3B. The theoretical open area "OA" of air directing grill 308, 310, within the exhaust area 353 of the of air stream 350, is equal to the exhaust area 353 minus the area of all of grill elements 352, ("AH" multiplied by "EW" multiplied by number "n" of grill elements 352) within exhaust area 353.

$$\text{exhaust area } 353 = AH \times AW$$

$$OA = \text{exhaust area } 353 - (AH \times EW \times n)$$

The theoretical open area "OA" of air directing grill 308, 310 within the exhaust area 353 of the of air stream 350 as it exits air directing grill 308, 310 is greater than about 60% of exhaust area 353 of air stream 350. This proportion enhances the ability of air stream 350 to exhaust from multi-directional fan 300 with minimal flow impedance.

$$OA > 0.6 \times \text{Exhaust Area } 353$$

It is contemplated that air directing grill 308, 310 may be constructed so as to be a separate component attached to multi-directional fan 300 or as an integral part of another component, such as upper and/or lower housings 304, 306, for example. As shown, the exemplary embodiment in FIGS. 3H–3J illustrates that air directing grill 308, 310 is comprised of grill elements 352 that are substantially vertical and linear. It is contemplated that other grill structures may be used such as: holes (substantially circular and/or substantially polygonal), diagonal elements and horizontal elements, or a combination of vertical, horizontal, diagonal elements to construct air directing grill 308, 310. The design and use of air directing grill 308, 310 serves to enhance the ability of air stream 350 to maintain velocity and be directed as desired.

Figure 1:
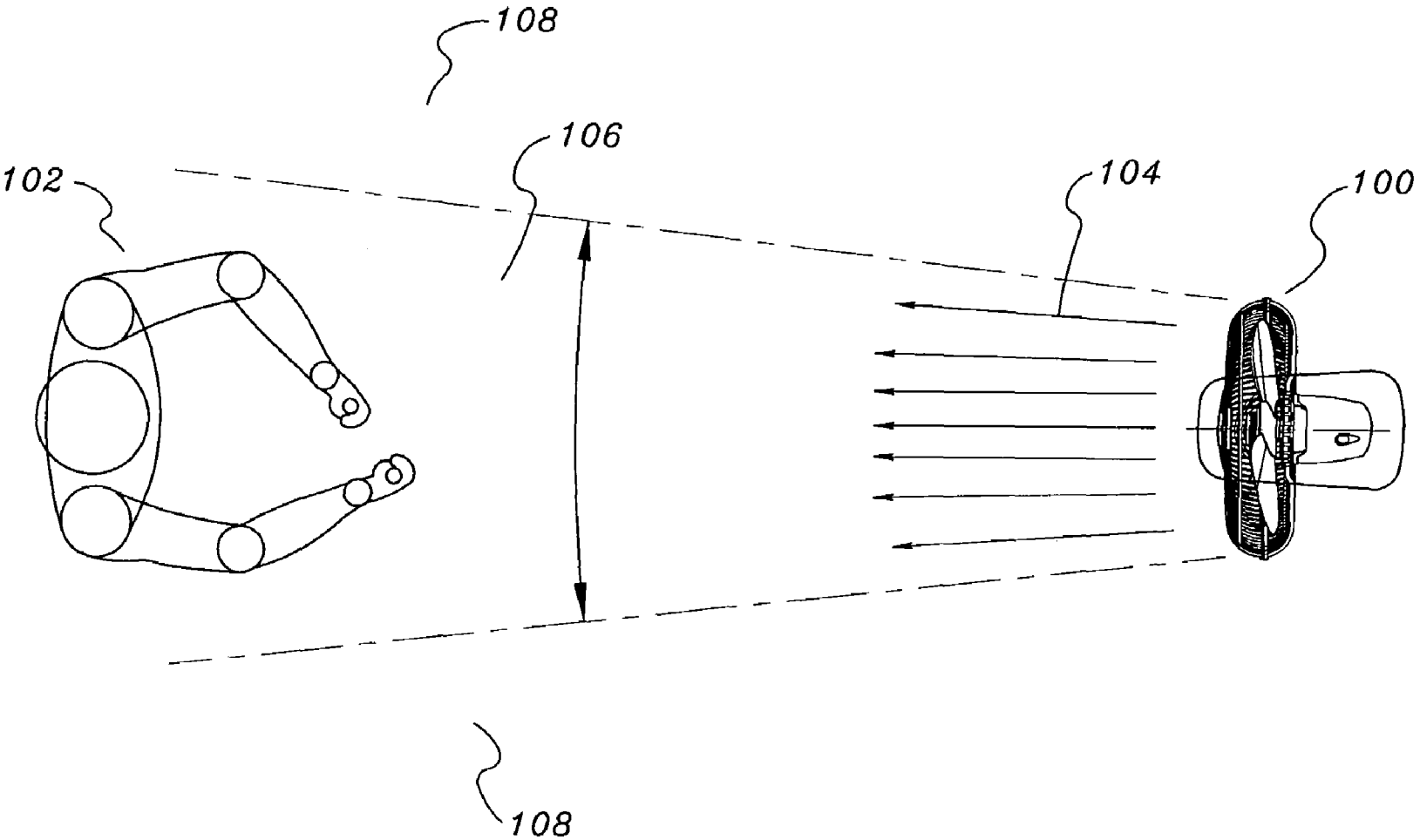
Fig. 1 (Prior Art)
FIG. 1 illustrates a conventional single directional fixed air movement device with limited air stream coverage area.
Figure 2:
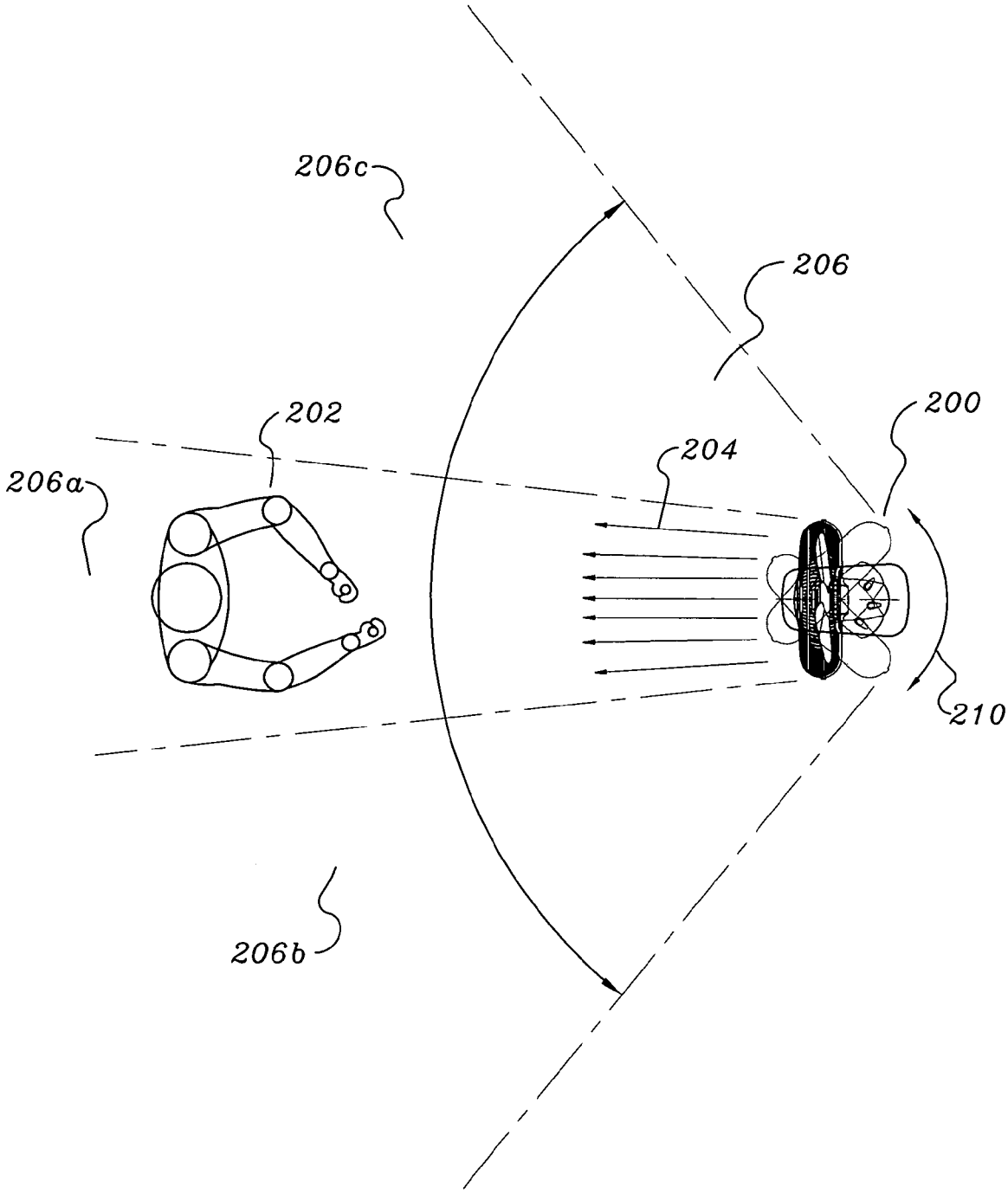
Fig. 2 (Prior Art)
FIG. 2 illustrates a conventional oscillating air movement device with a large air stream coverage area.
Figure 4:
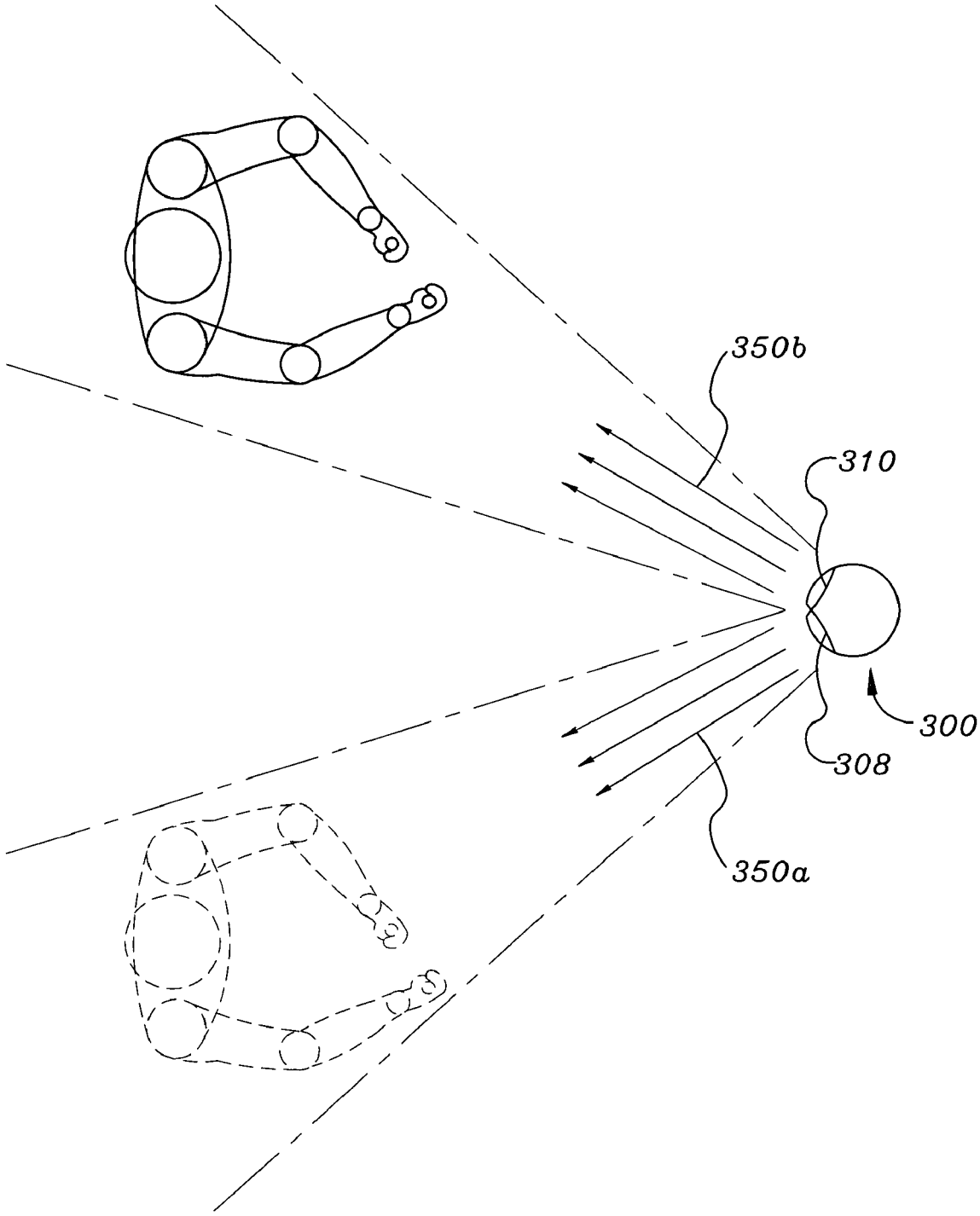
FIGS. 4–5 are plan views of multi-directional air flows and coverage areas in accordance with exemplary embodiments of the present invention.

As shown in FIG. 4, with the multi-directional air circulating fan 300 air stream 350 can be divided into multiple air streams 350*a*, 350*b* emanating from air directing grills 308, 310, respectively, thereby allowing the user or multiple users to benefit from the direct cooling effects of air stream 350 at multiple locations. This ability, as described, has advantages over the limited ability of the existing fixed air movement device 100 as shown and described with respect to FIG. 1, and does not have the disadvantages of the existing oscillating air movement device 200 as shown and described with respect to FIG. 2.

Figure 5:
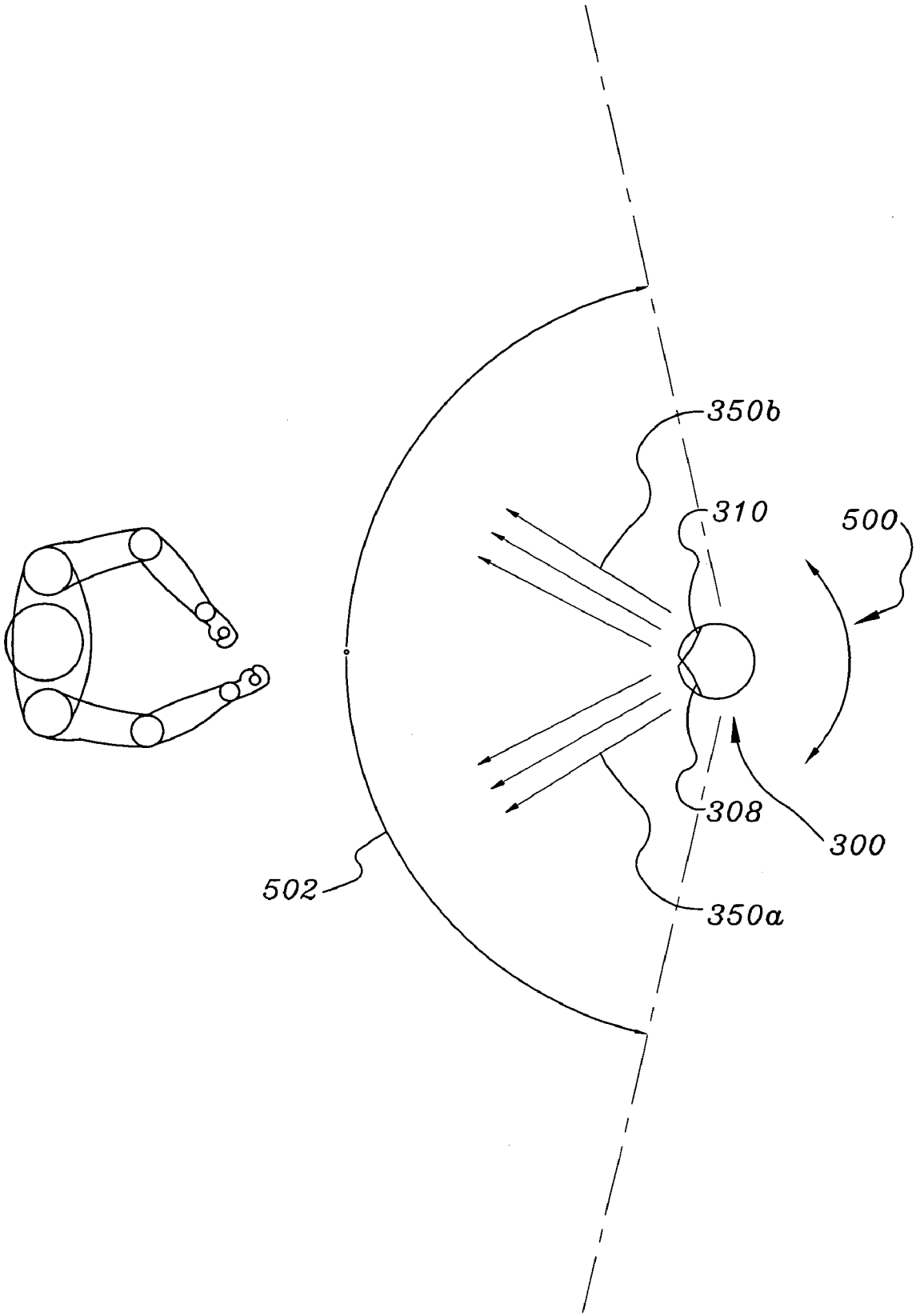

As shown in FIG. 5, in one exemplary embodiment, multi-directional air circulating fan 300 may oscillate in direction 500. As a result, air streams 350*a*, 350*b* provide cooling over angular area 502. As described above with respect to FIGS. 3A–3E, upper housing 306 is rotatable with respect to lower housing 304. As a result, the angular area of coverage 502 of air streams 350*a*, 350*b* is based on both the oscillation range and the relative angle between upper and lower sections 304, 306. This allows the user to benefit from the direct cooling effect of the air streams 350*a* and 350*b* more often during each oscillation cycle of multi-directional fan 300. This is because one of multiple air streams 350*a*, 350*b* will pass the user more frequently during the oscillation cycle as the multi-directional fan 300 moves through its oscillation motion 500. Further, because upper housing 306 is rotatable with respect to lower housing 304, air streams 350*a* and 350*b* can be directed so as to increase the angular area 502 that is covered by the air streams 350*a* and 350*b* as multi-directional fan 300 oscillates. This provides the user the option of covering a larger or smaller area with the air streams generated by multi-directional fan 300. These capabilities, as described, have advantages over existing oscillating air movement device 200 as shown and described with respect to FIG. 2.

Figure 6A:
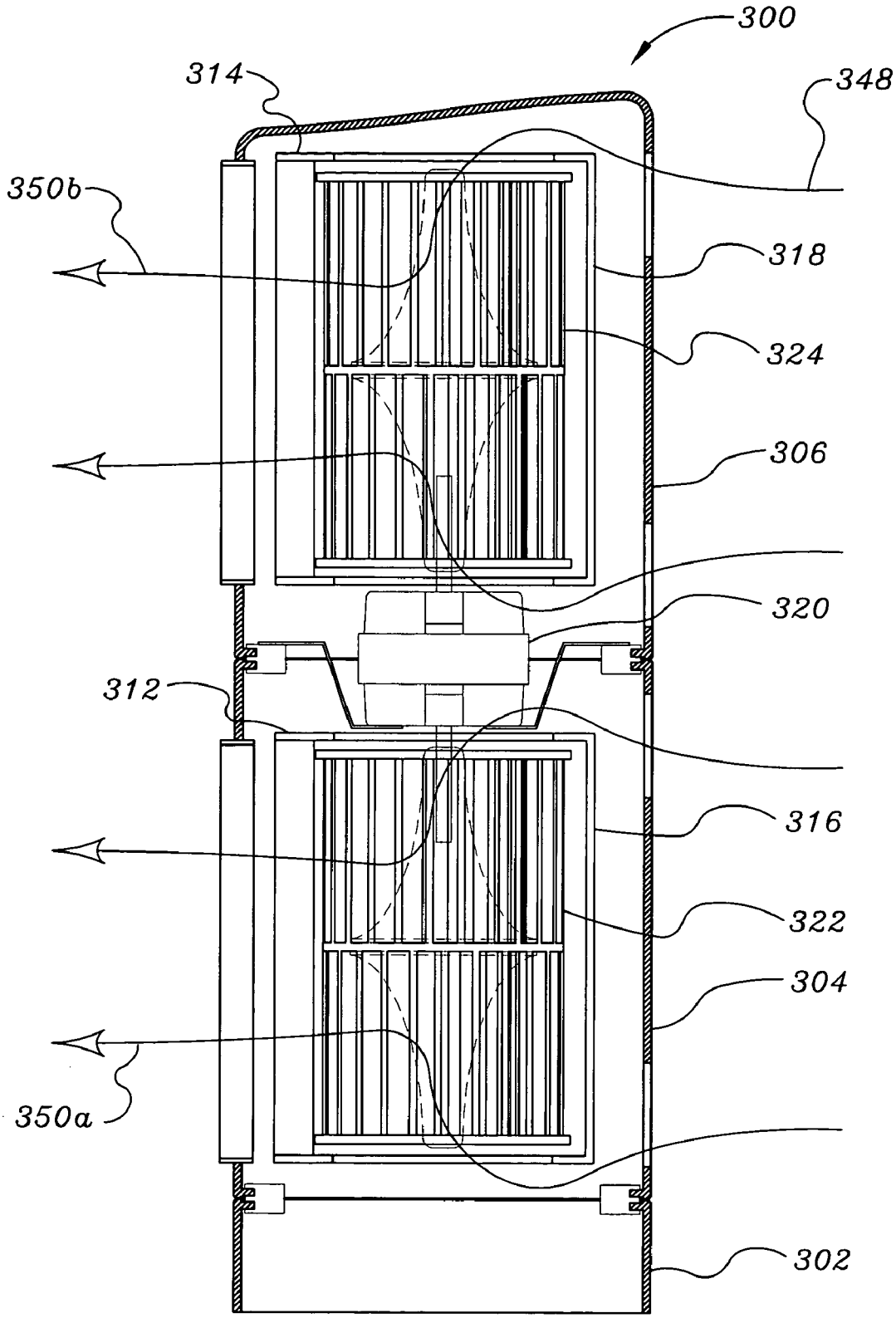
FIG. 6A illustrates another exemplary embodiment of a multi-directional air circulating fan utilizing an air generator with a blower air impeller design.

FIG. 6A illustrates another exemplary embodiment of multi-directional air circulating fan 300 that utilizes an air generator comprising air generator motor 320 coupled to two separate air impellers 322, 324. As shown in FIG. 6A, air impellers 322, 324 are consistent with a centrifugal blower design. Air generator motor 320 is located between air impellers 322 and 324, for example. This allows for the use of a single air generator motor 320 and thereby reduces manufacturing costs. Although FIG. 6A shows only two air impellers 322 and 324 and a single air generator motor 320, the invention is not so limited as discussed below.

Figure 6B:
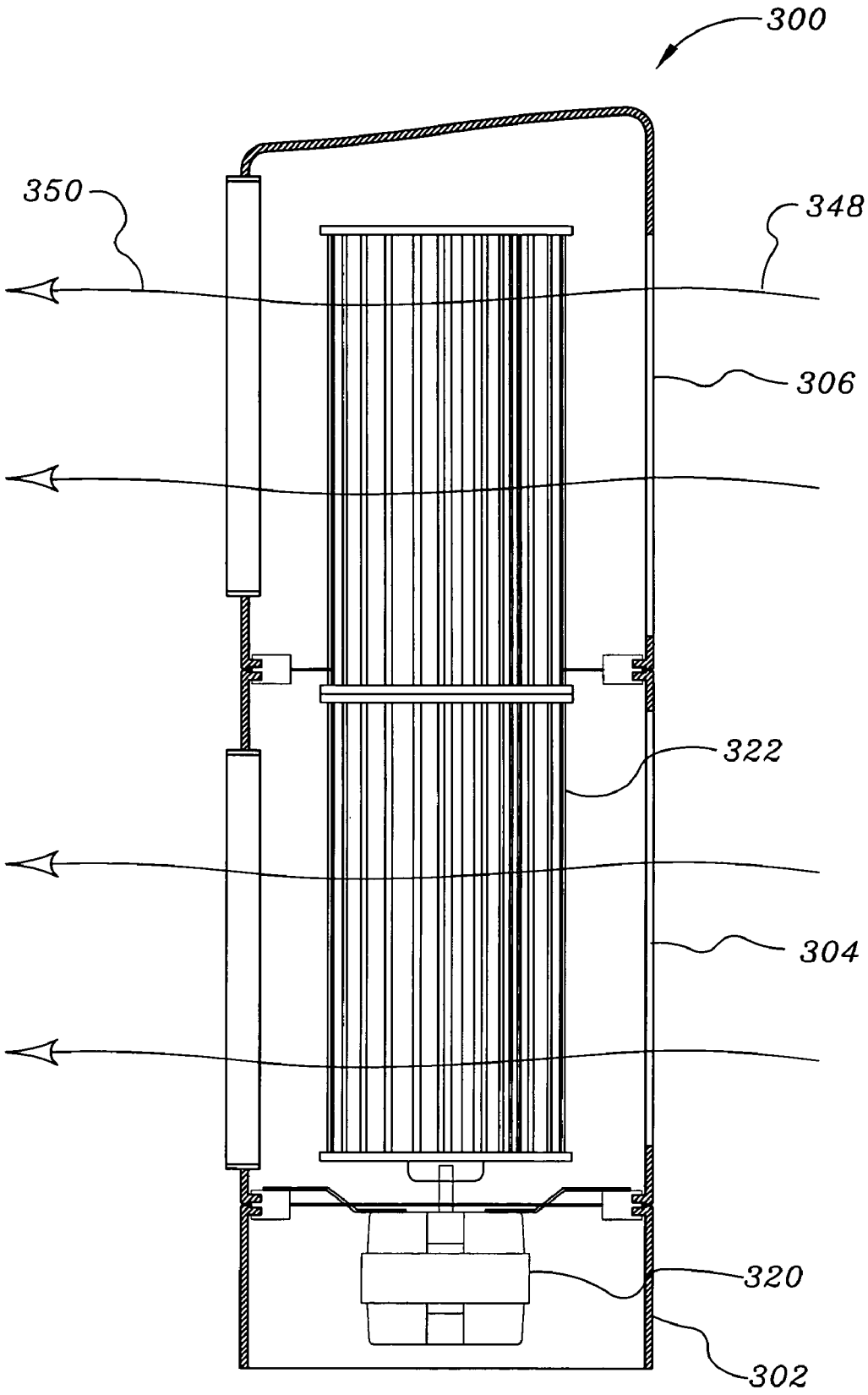
FIG. 6B illustrates another exemplary embodiment of a multi-directional air circulating fan utilizing an air generator with a transverse air impeller design.

FIG. 6B shows another exemplary embodiment of multi-directional air circulating fan 300 that utilizes an air generator comprising air generator motor 320 disposed within base 302 and coupled to an air impeller 322' which extends between lower housing 304 and upper housing 306. The illustration shows that air impeller 322' is consistent with a transverse blower design. Air generator motor 320 may be located at either end of the air impeller 322' or between multiple air impellers (not shown in this figure). Although FIG. 6B shows only one air impeller 322' and a single air generator motor 320, the invention is not so limited. For example, air impeller 322' may be a multi-section air impeller with adjacent sections coupled to one another, for example.

Figure 6C:
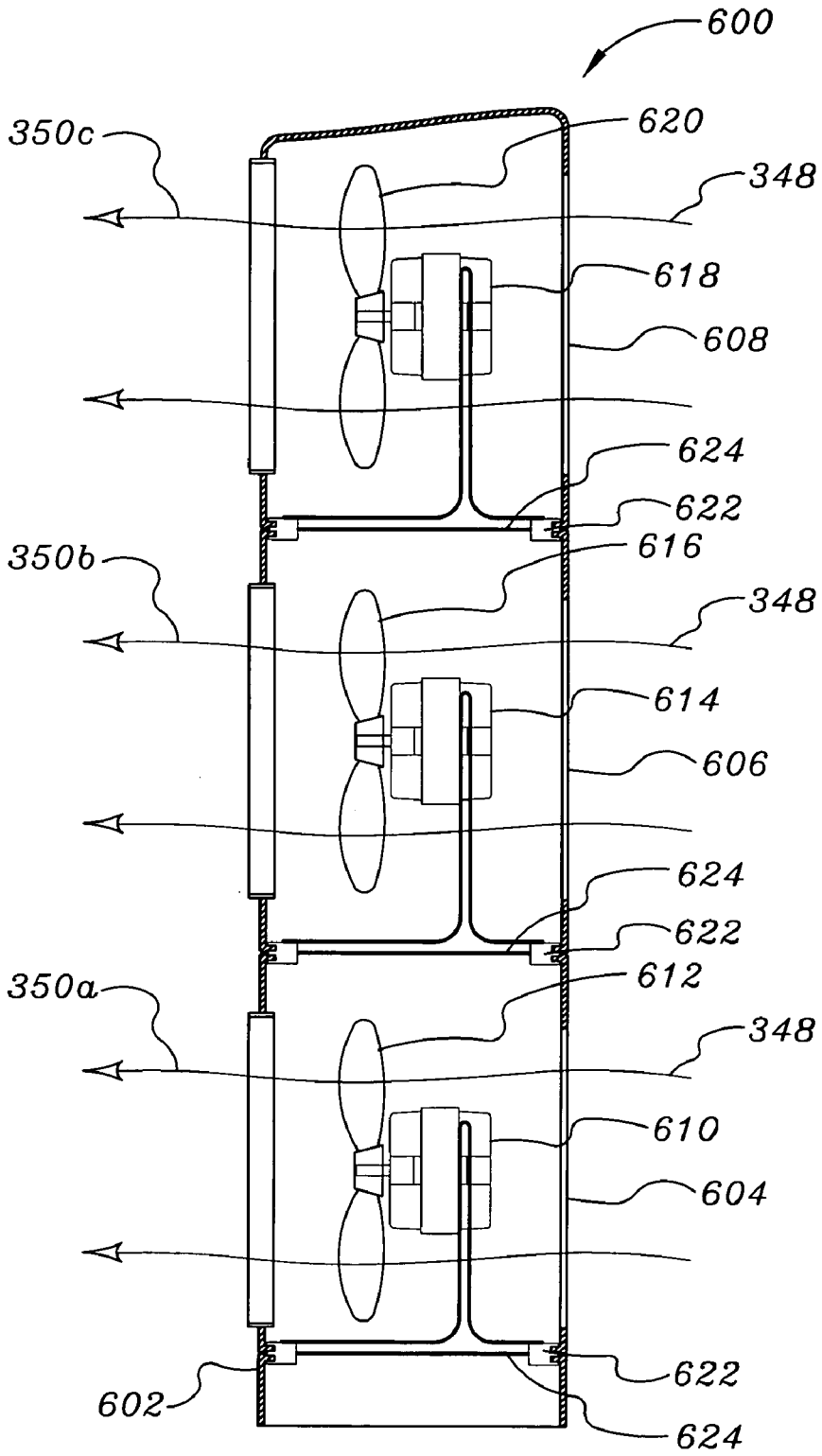
FIG. 6C illustrates another exemplary embodiment of a multi-directional air circulating fan utilizing an air generator with an axial air impeller design.

FIG. 6C shows another exemplary embodiment is of the multi-directional air circulating fan. As shown in FIG. 6C, multi-directional air circulating fan 600 utilizes separate air generators in each of the housings. In the non-limiting example shown in FIG. 6C, three housings 604, 606, and 608 are shown, with housing 604 coupled to optional base 602, housing 606 coupled at its lower end to housing 604 and at its upper end to housing 608. Each of housings 604, 606, and 608 being rotatable with respect to the housing(s) to which it is coupled. The coupling between the housings may be accomplished similarly to the approach described above with respect to the first exemplary embodiment. Alternatively, the coupling between the various housings and base may be achieved using a collar 622 having a barrier portion 624 to prevent air from flowing between adjacent sections. In all other respects, this embodiment is similar to the first exemplary embodiment, including the oscillation feature and exemplary range of rotation between adjacent housings.

In this embodiment, each air generator comprises an air generator motor 610, 614, 618 coupled to a respective air impeller 612, 616, 620. As shown, air impellers 612, 616, 620 have an axial air impeller design and generate respective air flows 350*a*, 350*b*, 350*c* from intake air 348. Although FIG. 6C shows only three air impellers 612, 616, 620 and three air generator motors 610, 614, 618, this does not limit the invention to only three air impellers and only three air generator motors, as the number of housings and respective air generators may be increased or decreased, as desired.

Figure 7:
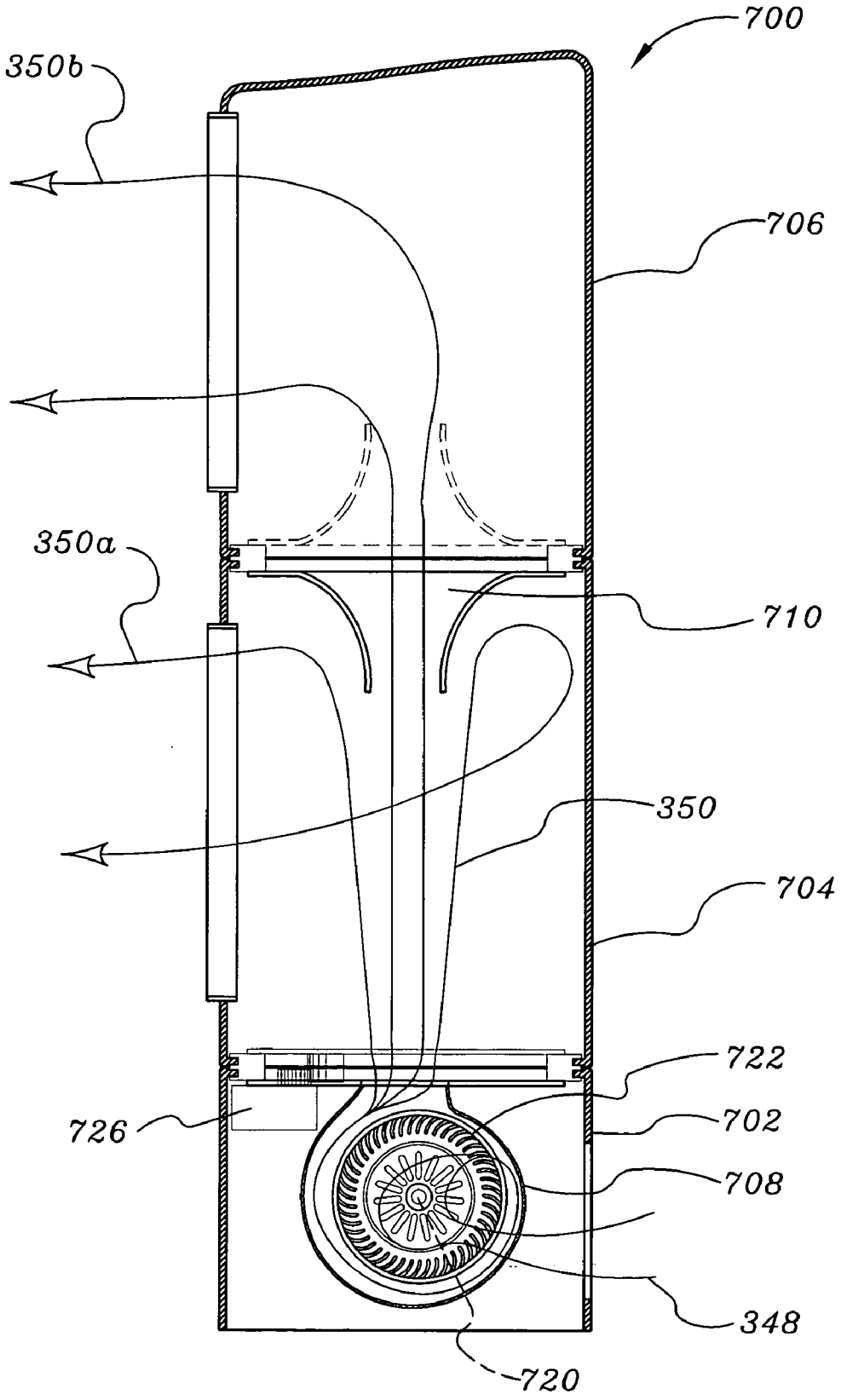
FIG. 7 illustrates another exemplary embodiment of a multi-directional air circulating fan utilizing an air generator with a blower air impeller design located in the base of the apparatus.

FIG. 7 shows another exemplary embodiment of the multi-directional air circulating fan. As shown in FIG. 7, multi-directional air circulating fan 700 utilizes an air generator 708 comprising at least one air generator motor 720 coupled to at least one air impeller 722. As shown, air impeller 722 is that of a centrifugal blower design. Air generator motor 720 and air impeller 722 may be located in base 702 of multi-directional air circulating fan 700, for example. This allows for the use of a single air generator thereby decreases the cost to manufacture the multi-directional fan 700.

In the exemplary embodiment of FIG. 7, intake air 348 enters base 702 and is converted into exhaust air 350. A portion of exhaust air 350 exits lower housing 704 as exhaust air 350*a* and the remaining exhaust air 350 passes into upper housing 706 through air passageway 710, shown in this embodiment as having an downward arcuate shape, and in-turn exhausted from upper housing 706 as exhaust air 350*b*. Although channel 710 may be formed as part of and/or disposed within lower housing 704, the invention is not so limited as it is possible to form channel 710 as a separate part, dispose it within upper housing 706 and/or form channel 710 in an upward arcuate or funnel shape, for example.

Similar to the aforementioned embodiments, the housings are rotatable with respect to one another. In addition, lower housing 704 may be rotatable and/or oscillate with respect to base 702. To accomplish the oscillation function, an oscillation motor 726 may be positioned in either base 702 or lower housing 704. In all other respects this embodiment is similar to the first exemplary embodiment.

Figure 8:
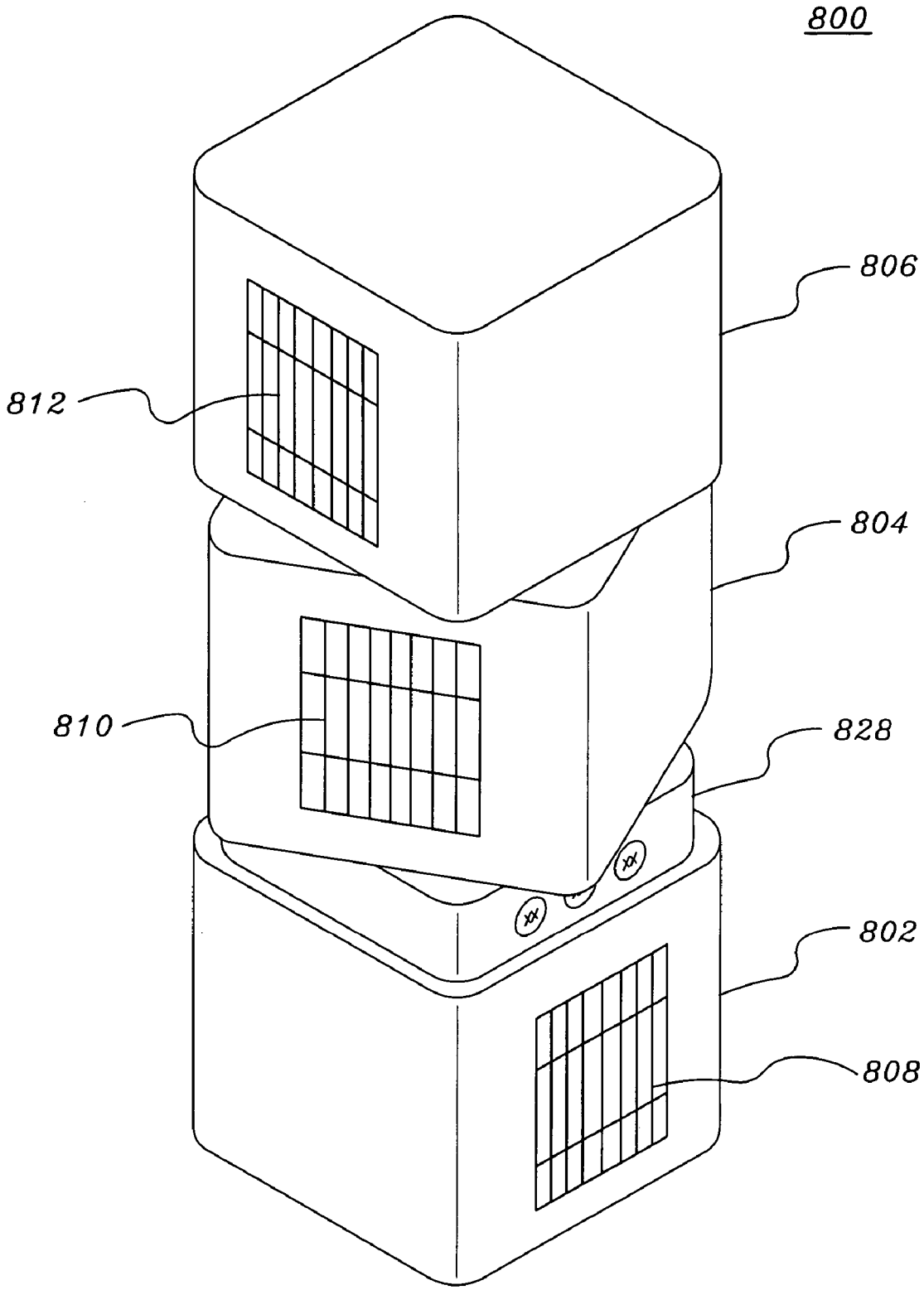
FIG. 8 illustrates another exemplary embodiment of a multi-directional air circulating fan.

FIG. 8 shows another exemplary embodiment of the multi directional air circulating fan. As shown in FIG. 8, multi-directional air circulating fan 800 is comprised of housings 802, 804, 806 having a substantially polygonal form. In a non-limiting version of this exemplary embodiment, control section 828 is disposed between the lower housing/base 802 and middle housing 804. One or more air generators (not shown) are disposed in any one of or all of housings 802, 804, 806 in accordance with the aforementioned exemplary embodiments. Air exits from housings 802, 804, 806 through air directing grills 808, 810, 812 respectively. Although FIG. 8 shows multi-directional air circulating fan 800 as having three sections, the invention is not so limited as any number of housing sections greater than one may be used as desired.

Figure 9:
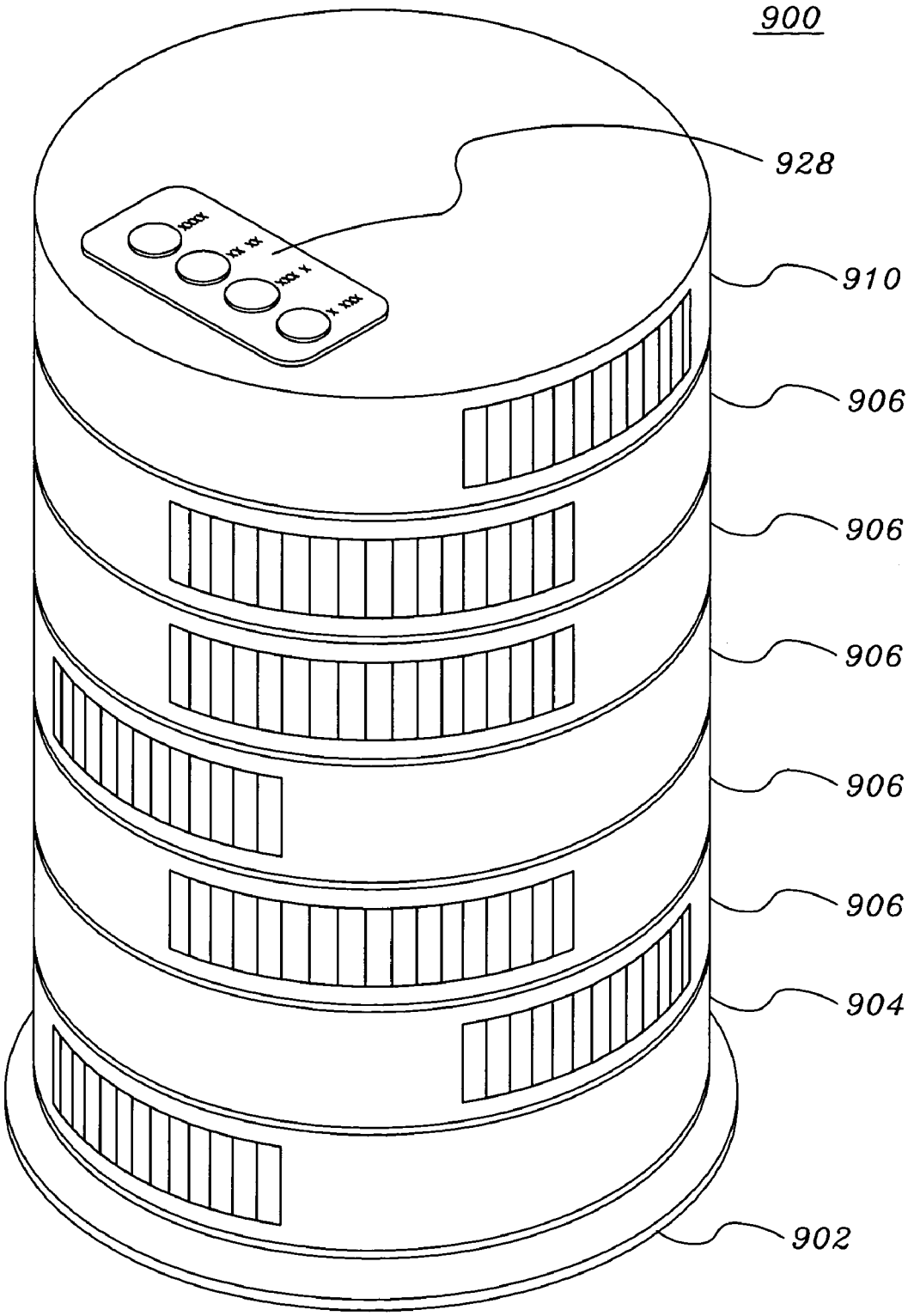
FIG. 9 illustrates another exemplary embodiment of the a multi-directional air circulating fan.

FIG. 9 shows another exemplary embodiment of the multi directional air circulating fan. As shown in FIG. 9, multi-directional air circulating fan 900, having a substantially cylindrical form, is shown and comprised of base 902, lower housing section 904, and any number of intermediate housing sections 906, and upper housing section 910. As shown in FIG. 9, controller 928 is included within top housing section 910. In all other respects this exemplary embodiment is similar to the aforementioned exemplary embodiments and includes any of the features of those embodiments.

Figure 10:
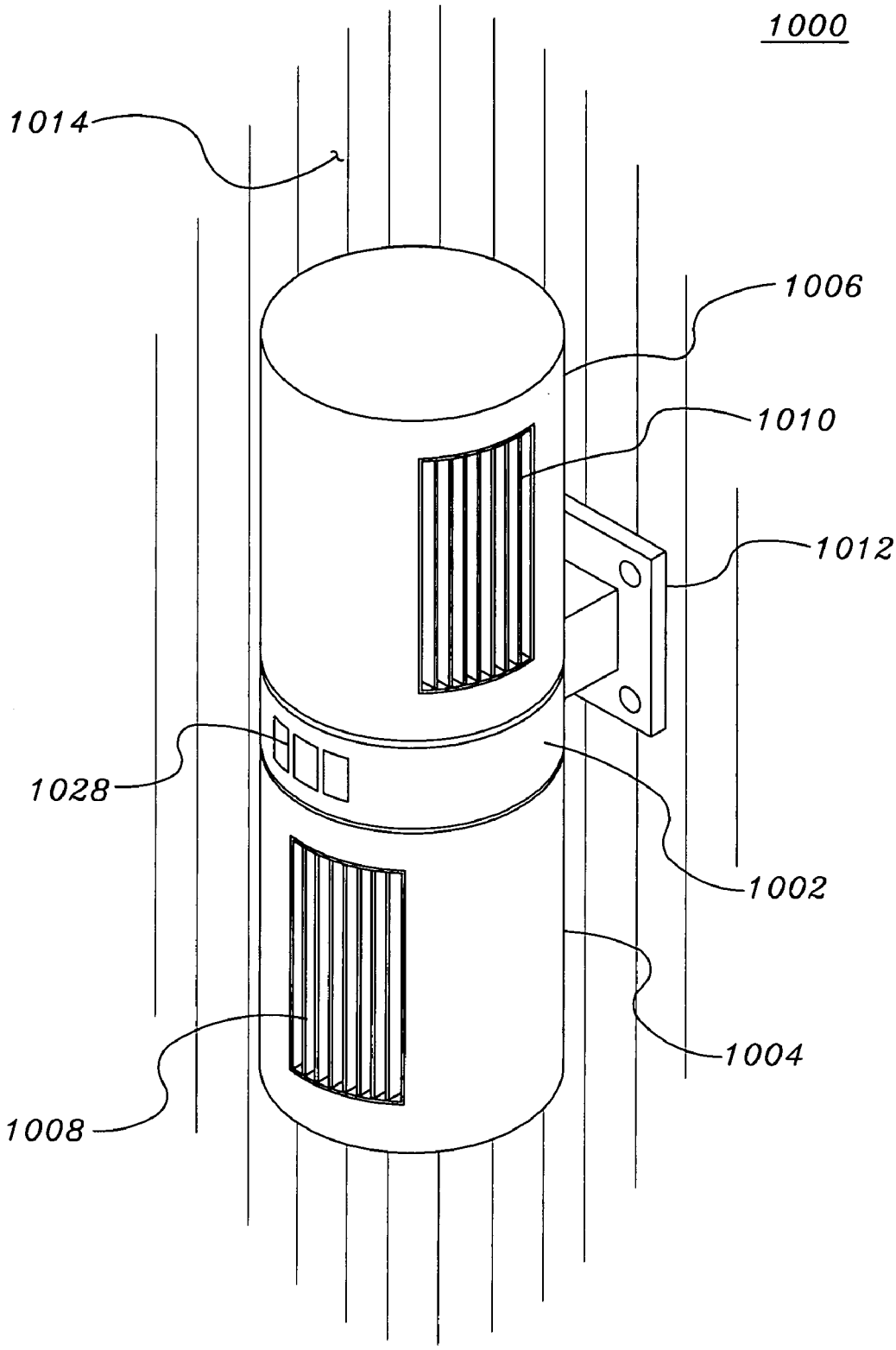
FIG. 10 illustrates another exemplary embodiments of the a multi-directional air circulating fan.

FIG. 10, shows another exemplary embodiment of the multi-directional air circulating fan. As shown in FIG. 10, multi-directional air circulating fan 1000 is comprised of lower housing 1004 and upper housing 1006, each coupled to intermediate section 1002 which may include control section 1028 if desired. Intermediate section 1002 is coupled to mounting bracket or mount 1012, which is in-turn used to mount multi-directional air circulating fan 1000 to a mounting surface 1014, such as a wall or ceiling, for example. Mounting bracket 1012 may be a separate part or an integral part of one of the components, such as intermediate section 1002, for example. Upper housing 1006 and/or lower housing 1004 may be rotatable and/or oscillate with respect to intermediate section 1002. An oscillation motor (not shown) may be disposed in intermediate section 1002, upper housing 1006 and/or lower housing 1004. It is also contemplated that upper and lower housings 1004, 1006 may oscillate in opposite directions if desired.

Intermediate section 1002 may be rotatable and/or oscillate with respect to mounting bracket 1012. This would allow multi-directional air circulating fan 1000 to rotate and/or oscillate with respect to mounting surface 1014.

As illustrated in FIG. 10, multi-directional air circulating fan 1000 is mounted in a substantially vertical position. The invention is not so limited, however, in that it is also contemplated that multi-directional air circulating fan 1000 could be mounted at any angle including a substantially horizontal position or on a ceiling.

While the embodiments of the invention have been shown having a substantially vertical orientation other orientations, such as horizontal are contemplated.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A multi-directional air circulation device for use in a living space, said device comprising:

a base;

a first housing comprising:

i) a first wall portion defining a first interior space, ii) a first air outlet, and iii) a first air directing grill adjacent to said first air outlet;

at least a second housing rotatable with respect to said first housing, said second housing comprising:

i) a second wall portion defining a second interior space, ii) a second air outlet and, iii) a second air directing grill adjacent to said second air outlet; and at least one air generator, said at least one air generator used to generate at least one air stream, said at least one air stream being discharged from said device via said first and second air outlets and said first and second air directing grills as at least two air exhaust streams, said at least two air exhaust streams being independently directed from one another, wherein said air directing grills each have a plurality of grill elements to direct said air exhaust streams and said air exhaust streams have a maximum velocity vector co-linear to respective centerlines of said air directing grills within an angle of +/−35 degrees relative to the centerline of said air directing grills.

2. The device according to claim 1, wherein said first housing and said at least a second housing rotate about a common axis of rotation.

3. The device according to claim 1, further comprising more than two housings, each of said housings comprising a respective first end and a respective second end, wherein said more than two housings are aligned substantially end to end such that said first end of said second housing is proximate said second end of said first housing and said respective second end of each successive housing is proximate said respective first end of each preceding housing.

4. The device according to claim 1, wherein said base is coupled to at least one of i) said first housing, ii) said at least a second housing, and/or iii) between any two housings.

5. The device according to claim 4, wherein said housings at least one of rotate and oscillate with respect to said base.

6. The device according to claim 4, further comprising an oscillator for oscillating at least one of said housings with respect to said base over a predetermined angular range.

7. The device according to claim 6, wherein said predetermined angular range is at least 30 degrees.

8. The device according to claim 1, further comprising a controller for controlling an operation of said device.

9. The device according to claim 8, wherein said controller further controls at least one of i) speed, ii) rotation, and iii) oscillation of said device.

10. The device according to claim 8, wherein said controller is disposed in said base and said base is coupled to one of said first housing, said at least a second housing, and between any two housings.

11. The device according to claim 1, wherein said air generator further comprises:

a motor at least partially disposed in at least one of said first housing and/or said at least a second housing; and at least one air impeller coupled to said motor, said at least one air impeller at least partially disposed in said first housing and/or said at least a second housing.

12. The device according to claim 11, wherein said air generator is a centrifugal blower.

13. The device according to claim 11, wherein said air impeller is in substantially direct fluid communication with said air directing grills.

14. The device according to claim 1, wherein said base is coupled to said first housing, and said air generator further comprises:

a motor at least partially disposed within said base; and at least one air impeller coupled to said motor, said at least one air impeller at least partially disposed within one of i) said first housing, ii) said at least a second housing, and iii) said base.

15. The device according to claim 14, wherein said air generator is a transverse blower.

16. The device according to claim 14, wherein said air impeller is in direct fluid communication with said air directing grills.

17. A multi-directional air circulation device for use in a living space, said device comprising:

a base;

a first housing comprising:

i) a first wall portion defining a first interior space, ii) a first air outlet, and iii) a first air directing grill adjacent to said first air outlet;

at least a second housing rotatable with respect to said first housing, said second housing comprising:

i) a second wall portion defining a second interior space, ii) a second air outlet and, iii) a second air directing grill adjacent to said second air outlet;

a respective air inlet in at least one of said first housing, said second housing and/or said base to receive inlet air; and at least one air generator, said at least one air generator used to generate at least one air stream, said at least one air stream being discharged from said device via said first and second air outlets and said first and second air directing grills as at least two air exhaust streams, said at least two air exhaust streams being independently directed from one another, wherein said first housing and said at least a second housing further comprise respective wall members to divide said first and second interior spaces into respective inlet interior spaces and outlet interior spaces to substantially prevent said exhaust air streams from mixing with said inlet air.

18. The device according to claim 1, wherein said plurality of grill elements are at least one of holes disposed in said air directing grills and slats coupled between frame members of said air directing grills.

19. The device according to claim 1, wherein said air directing grills have a flow through area greater than 60% of an area of said air exhaust streams.

20. The device according to claim 1, wherein a reduction of a velocity of a maximum velocity vector of said air exhaust streams when measured at 18 inches from a face of said air directing grills is less than 80% of a maximum face velocity of said air exhaust streams when measured on the surface of an air exit side of said air directing grills.

21. The device according to claim 1, wherein a maximum face velocity of said air exhaust streams is greater than 475 feet per minute when measured on a surface of said air directing grills where said air exhaust streams exit from said device.

22. The device according to claim 1, wherein said at least a second housing is rotatable with respect to said first housing over an angular range of up to 90 degrees.

23. The device according to claim 1, wherein said at least a second housing is rotatable with respect to said first housing over an angular range of up to 360 degrees.

24. The device according to claim 1, wherein said air generator further comprises:

a respective plurality of motors at least partially disposed within said respective housings; and a respective plurality of impellers coupled to said plurality of motors and disposed within said respective housings.

25. The device according to claim 24 wherein said air generator comprises a plurality of axial fans.

26. The device according to claim 1, wherein said first housing and said at least a second housing have one of a substantially polygonal shape or a substantially circular shape.

27. The device according to claim 1 further comprising:

an air passage formed between said first housing and said second housing for communicating at least a portion of said at least one air stream from said first housing into said at least a second housing, wherein said base is coupled to said first housing and said air generator is disposed within said base, said air generator providing said at least one air stream into said first housing.

28. The device according to claim 27, wherein said first housing is coupled to said base to at least one rotate and oscillate with respect to said base.

29. The device according to claim 27, wherein at least a portion of said first housing, at least a portion of said at least a second housing, and at least a portion of said base are coupled to one another in a substantially fluid tight relationship.

30. The device according to claim 1, further comprising a controller to control at least one of power to the device, oscillation of at least one of said housings, and a speed of said air generator.

31. The device according to claim 1, wherein said housings are aligned substantially vertically and said device comprises an aspect ratio of a height to the greater of a width, depth or diameter of said device is greater than 2:1.

32. The device according to claim 1, wherein said device is portable and for use on a substantially horizontal mounting surface.

33. A multi-directional air circulation device for use in a living space, said device comprising:

a first housing comprising:

i) a first wall portion defining a first interior space, ii) a first air outlet, and iii) a first air directing grill adjacent to said first air outlet;

at least a second housing rotatable with respect to said first housing, said second housing comprising:

i) a second wall portion defining a second interior space, ii) a second air outlet and, iii) a second air directing grill adjacent to said second air outlet; and at least one air generator comprising:

i) a motor at least partially disposed in at least one of said first housing and/or said at least a second housing, and ii) at least one air impeller coupled to said motor, said at least one air impeller at least partially disposed in said first housing and/or said at least a second housing, wherein said at least one air generator used to generate at least one air stream, said at least one air stream being discharged from said device via said first and second air outlets and said first and second air directing grills as at least two air exhaust streams, said at least two air exhaust streams being independently directed from one another, said air directing grills each have a plurality of grill elements to direct said air exhaust streams and said air exhaust streams have a maximum velocity vector co-linear to respective centerlines of said air directing grills within an angle of +/−35 degrees relative to the centerline of said air directing grills.

34. The device according to claim 33, further comprising a mount for coupling said device to a mounting surface.

35. The device according to claim 34, wherein said mount is a bracket coupled between i) at least one of said first housing, said at least a second housing, and said any two housings, and ii) said mounting surface.

36. The device according to claim 34, wherein said mount is rotatably coupled to at least one said first and second housings allowing at least one of manual and automatic rotational movement of said device with respect to said mounting surface.

37. The device according to claim 34, wherein said mounting surface is a substantially vertical surface.

38. The device according to claim 33, wherein said first housing and said at least a second housing rotate about a common axis of rotation.

39. The device according to claim 33, wherein said air impeller is in substantially direct fluid communication with said air directing grills.

40. The device according to claim 33, wherein said air generator is a centrifugal blower.

41. The device according to claim 33, wherein said air generator is a transverse blower.

42. A method for providing multi-directional air circulation within a living space, the method comprising:

rotatably coupling a first housing to a base member;

rotatably coupling at least a second housing to one of said first housing and said base member;

engaging said base member with a surface;

rotating an air impeller at least partially disposed within at least one of said first housing, said second housing and/or said base member;

drawing air into one of said first housing, said second housing and/or said base member;

generating at least one air stream within one of said first housing, said at least a second housing, and/or said base member;

discharging respective air exhaust streams from said first housing and said at least a second housing based on said at least one air stream; and directing said air exhaust streams, via air directing grills each having a plurality of grill elements, into said living space independent from one another such that said air exhaust streams have a maximum velocity vector co-linear to respective centerlines of said air directing grills within an angle of +/−35 degrees relative to the centerline of said air directing grills.

* * * * *